US008316517B2

(12) United States Patent
Fujiwara

(10) Patent No.: US 8,316,517 B2
(45) Date of Patent: Nov. 27, 2012

(54) POMPON MAKING TOOL

(75) Inventor: Yasuhiro Fujiwara, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 340 days.

(21) Appl. No.: 12/861,527

(22) Filed: Aug. 23, 2010

(65) Prior Publication Data

US 2011/0113607 A1 May 19, 2011

(30) Foreign Application Priority Data

Aug. 25, 2009 (JP) ..... 2009-194153

(51) Int. Cl.
*D04D 7/06* (2006.01)

(52) U.S. Cl. ..... 28/147; 223/46

(58) Field of Classification Search ..... 28/147, 28/149, 145, 150, 143, 100; 223/46, 44, 223/61; 26/71, 80, 87
See application file for complete search history.

(56) References Cited

U.S. PATENT DOCUMENTS 1,430,737 A * 10/1922 Harwood ..... 82/47
1,872,281 A * 8/1932 Hansen ..... 28/150
2,062,183 A * 11/1936 Lawson et al. ..... 28/147
2,521,863 A * 9/1950 Mertz ..... 223/46
2,660,777 A * 12/1953 Cruz ..... 28/150
3,000,074 A * 9/1961 Butkiewicz ..... 28/147
3,110,077 A * 11/1963 Spear ..... 28/147
3,287,785 A * 11/1966 Ciroli ..... 28/147
3,413,699 A * 12/1968 Millay ..... 28/147
3,870,207 A * 3/1975 Gosse ..... 223/46

FOREIGN PATENT DOCUMENTS

JP 2002-317362 10/2002

* cited by examiner

*Primary Examiner* — Amy Vanatta
(74) *Attorney, Agent, or Firm* — Hamre, Schumann, Mueller & Larson, P.C.

(57) ABSTRACT

A pompon making tool includes a first member and a second member to be superposed on each other. The first member includes a pair of arms movable relative to each other, and each arm includes an arcuate portion. Likewise, the second member includes a pair of arms movable relative to each other, and each arm includes an arcuate portion. The arcuate portions of the first and the second member each include a base plate portion, and a pair of thread support portions spaced apart from each other in the width direction of the base plate portion. The thread support portions each include a top portion on the outer side of the base plate portion and extend in the longitudinal direction of the arcuate portion.

11 Claims, 24 Drawing Sheets

POMPON MAKING TOOL

BACKGROUND OF THE INVENTION

1. Field of the Invention

The present invention relates to a tool for making a pompon used for ornamental purposes.

2. Description of the Related Art

Various pompon making tools have so far been proposed. FIGS. 32 and 33 depict a pompon making tool disclosed in JP-A-2002-317362. The conventional pompon making tool B includes a first member 91A and a second member 91B. The first member 91A includes a pair of arms 92A, 93A and a support member 94A that supports the arms 92A, 93A. The arms 92A, 93A each include an arcuate portion 920A, 930A of a semicircular arch shape. An end portion of the arms 92A, 93A is pivotally supported by a support member 94A, so that the arcuate portions 920A, 930A can be joined to each other generally in a ring shape. The second member 91B is similarly configured to the first member 91A, and includes a pair of arms 92B, 93B each including an arcuate portion 920B, 930B of a semicircular arch shape, and a support member 94B pivotally supporting the arms 92B, 93B.

With the pompon making tool B, a pompon can be made as follows. First, a shaft 950 of the first member 91A is fitted in a bore 951 of the second member 91B, so that the first member 91A and the second member 91B are coupled. Then, the arms 92A and 92B are aligned as shown in FIG. 33. The other arms 93A and 93B are also aligned, like the arms 92A and 92B. Then a thread Y91 is wound about the arcuate portions 920A, 920B. Likewise, the thread Y91 is also wound about the arcuate portions 930A, 930B. As shown in FIG. 34, the arms 92A, 92B and the arms 93A, 93B are rotated so as to form ring-shaped set of the arcuate portions 920A, 920B and the arcuate portions 930A, 930B. In this state, the thread Y91 is cut at a position indicated by n1 in FIG. 35, so that the thread Y91 is divided into a plurality of threads Y91' of a generally uniform length as shown in FIG. 36. Then another thread Y92 is passed through a clearance 960 between the first member 91A and the second member 91B as shown in FIG. 37, and the thread Y91' is tied by the thread Y92. Finally the shaft 950 is removed from the bore 951, to thereby separate the first member 91A and the second member 91B. Thus, the spherical pompon P9 shown in FIG. 38 is obtained.

SUMMARY OF THE INVENTION

The conventional pompon making tool can only make a spherical pompon. Accordingly, an object of the present invention is to provide a pompon making tool appropriate for making a pompon of a shape different from a sphere.

A pompon making tool provided according to the present invention includes: a first member including a pair of arms movable relative to each other, each of the arms including an arcuate portion; and a second member to be superposed on the first member, the second member including a pair of arms movable relative to each other, each of the arms including an arcuate portion. The arcuate portions each include a base plate portion, and a pair of thread support portions spaced apart from each other in the width direction of the base plate portion. The thread support portions each include a top portion on the outer side of the base plate portion and extend in the longitudinal direction of the arcuate portion.

Preferably, in a cross section of each of the arcuate portions, the length from the inner periphery of the base plate portion to the outer periphery thereof via the respective top portions of the paired thread support portions is different according to a position in the longitudinal direction of the arcuate portion.

Preferably, the paired thread support portions and the base plate portion of each of the arcuate portions are arcuate in the longitudinal direction, and the height of each of the thread support portions from the base plate portion to the top portion is different according to a position in the longitudinal direction.

Preferably, the top portion of each of the thread support portions is provided with a plurality of projections at intervals in the longitudinal direction that project in a direction in which the first member and the second member are to be superposed on each other.

Preferably, the first member and the second member each include a support member that pivotally supports the paired arms so as to allow the arcuate portions of the paired arms to join together in a ring shape. The support member of the first member and that of the second member are detachably connectable.

Preferably, each of the support members includes a flange portion spreading orthogonally to the direction in which the first member and the second member are to be superposed on each other. When the arcuate portions of the paired arms are joined together in a ring shape, a clearance is defined between an inner one of the paired thread support portions and the outer periphery of the flange portion, while the base plate portion and a face of the flange portion face each other in the superposing direction of the first member and the second member with a clearance therebetween.

Preferably, the flange portion includes, on the face thereof that is oriented inward when the first member and the second member are superposed on each other, a rib protruding in the superposing direction of the first member and the second member.

Preferably, a face of the base plate portion and a face of the flange portion that face each other are respectively provided with projecting pieces sticking out in the superposing direction of the first member and the second member, at a position corresponding to where the height of the paired thread support portions from the base plate portion to the top portion is relatively low.

Preferably, the base plate portion of the first member and that of the second member which overlap each other when the first member and the second member are superposed on each other are provided, on mutually facing surfaces thereof, with positioning means for achieving positioning by fitting a projection and a recess.

Preferably, the arcuate portions each is provided with a plurality of guide projections formed on the outer periphery thereof, such that each of the guide projections on one of the arcuate portions forms a pair with a respective one of the guide projections of the facing arcuate portion at a longitudinally corresponding position when the arcuate portions of the paired arms are joined together in a ring shape with the first member and the second member superposed on each other.

Preferably, the arcuate portions each is provided, on the outer periphery thereof, with a hook portion for engaging a thread, such that the hook portion of one of the arcuate portions forms a pair with that of the facing arcuate portion at a longitudinally corresponding position when the arcuate portions of the paired arms are joined together in a ring shape with the first member and the second member superposed on each other.

Other features and advantages of the present invention will become more apparent from the detailed description given below referring to the accompanying drawings.

DETAILED DESCRIPTION OF THE PREFERRED EMBODIMENTS

Preferred embodiments of the present invention will be described below with reference to the drawings.

Figure 1:
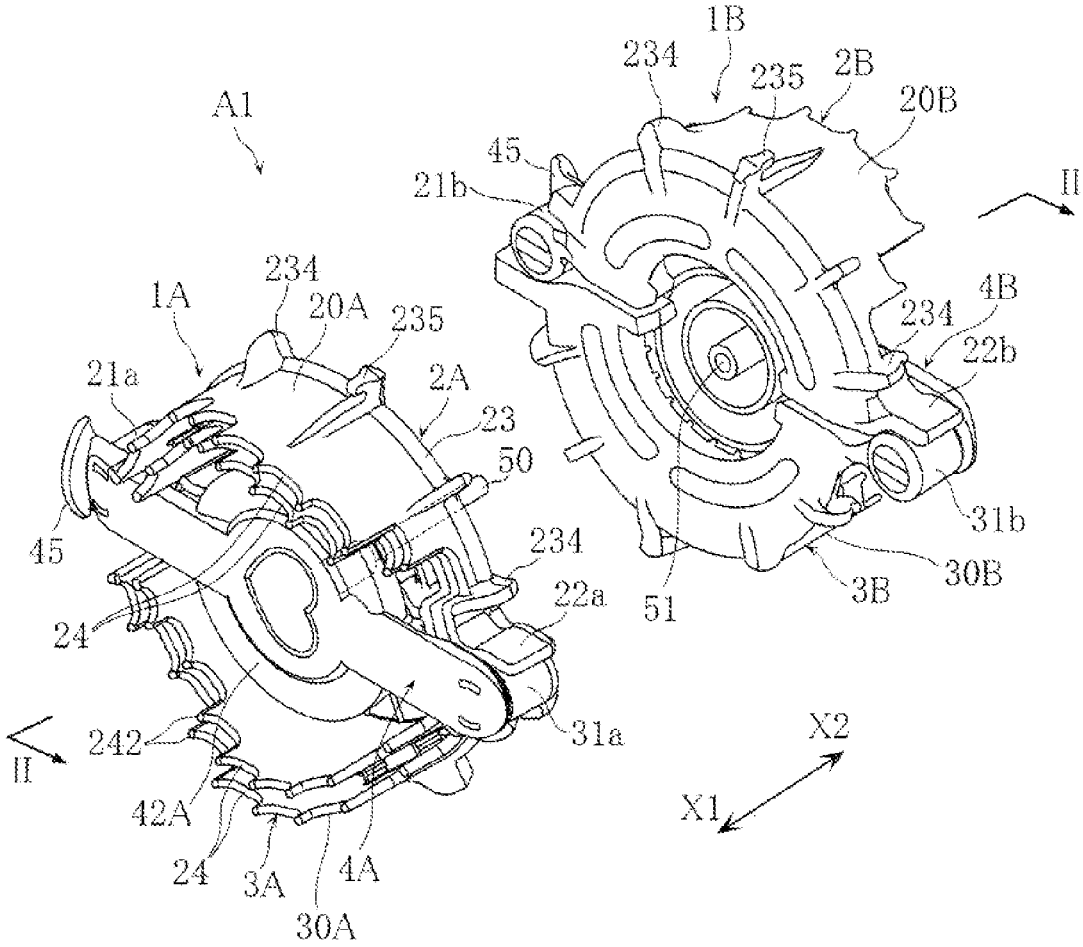
FIG. 1 is a perspective view showing a pompon making tool according to a first embodiment of the present invention.
Figure 2:
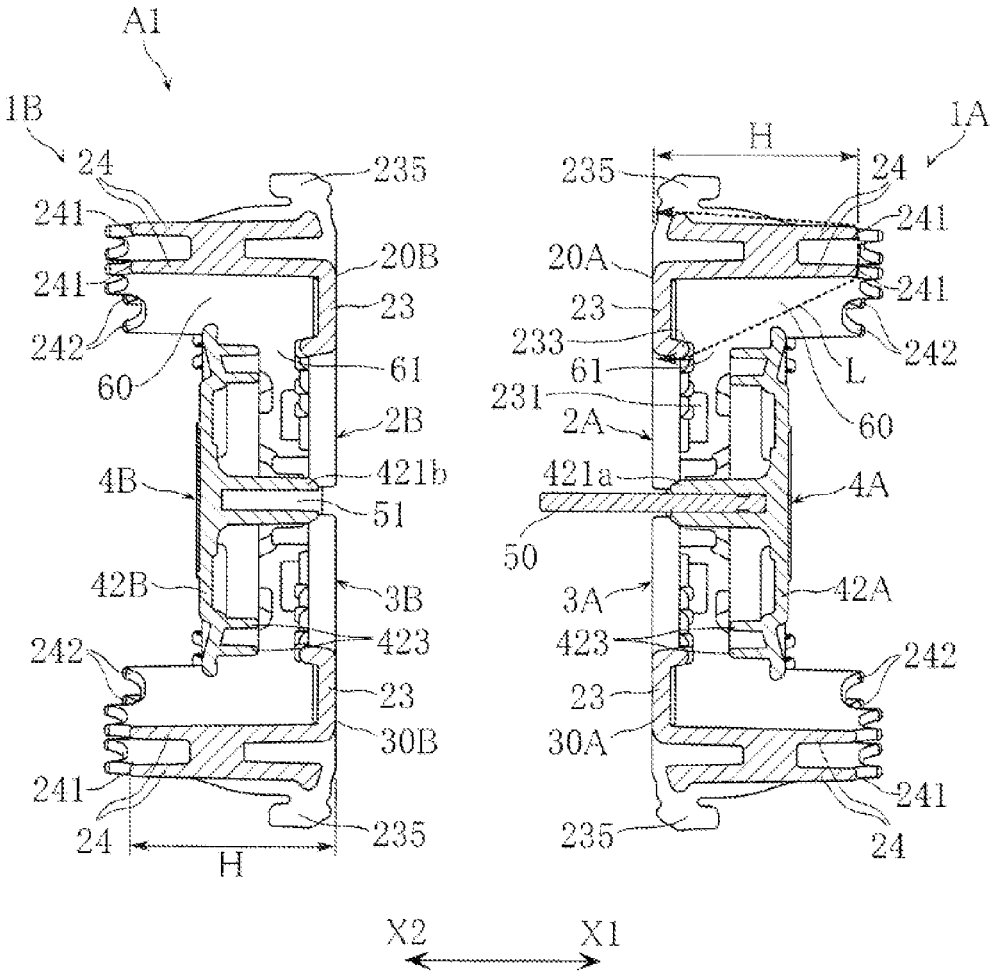
FIG. 2 is a cross-sectional view taken along lines II-II in FIG. 1.

FIGS. 1 to 7 depict a pompon making tool according to a first embodiment of the present invention. As shown in FIGS. 1 and 2, the pompon making tool A according to the first embodiment includes a first member 1A and a second member 1B.

The first member 1A includes a pair of arms 2A, 3A and a support member 4A. To the support member 4A, a shaft 50 is attached for coupling the first member 1A and the second member 1B to each other.

Figure 3:
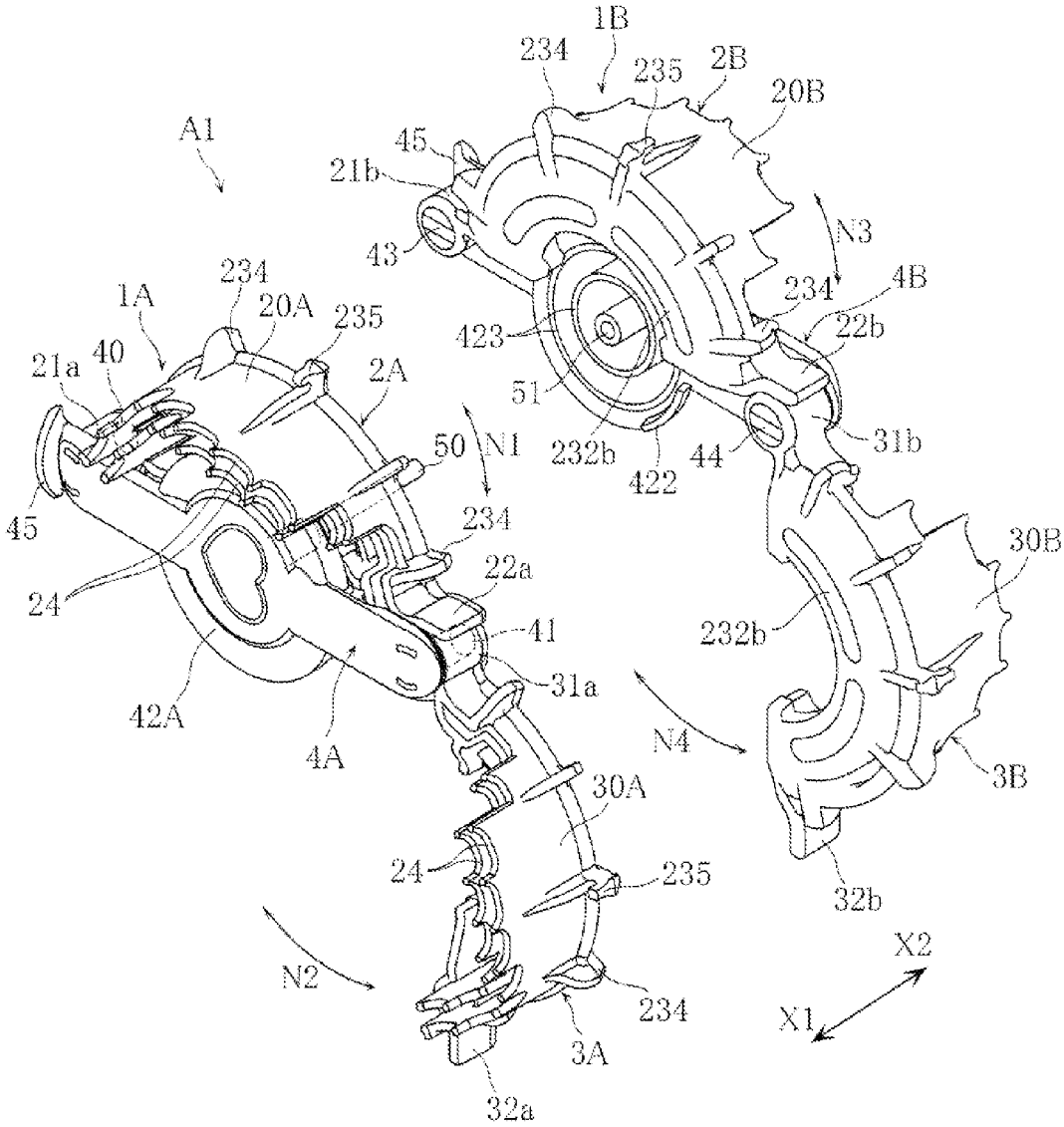
FIG. 3 is a perspective view showing the pompon making tool of FIG. 1, assuming a different arm angle.

The arms 2A and 3A are made of a synthetic resin such as an ABS resin. The arm 2A includes an arcuate portion 20A of a semicircular arch shape, and assisting portions 21*a* and 22*a* integrally connected to opposite ends of the arcuate portion 20A. As shown in FIG. 3, an end of the assisting portion 21*a* is connected to one of opposite ends of the support member 4A via a shaft portion 40. This connection permits the arm 2A to rotate about the shaft portion 40 in the direction indicated by an arrow N1. The arm 3A also includes, like the arm 2A, an arcuate portion 30A of a semicircular arch shape, and assisting portions 31*a* and 32*a* integrally connected to opposite ends of the arcuate portion 30A. An end of the assisting portion 31*a* is connected to the other end of the support member 4A via a shaft portion 41. The arm 3A is rotatable about the shaft portion 41 in the direction of an arrow N2. As is apparent from FIG. 1, when the pair of arms 2A and 3A are brought close to each other, the two arcuate portions 20A and 30A are joined together in a ring shape. Also, the assisting portion 22*a* of the arm 2A comes into contact with the assisting portion 31*a* of the arm 3A, and the assisting portion 32*a* of the arm 3A comes into contact with the assisting portion 21*a* of the arm 2A. Such configuration stabilizes the position of the pair of arms 2A and 3A.

Figure 5:
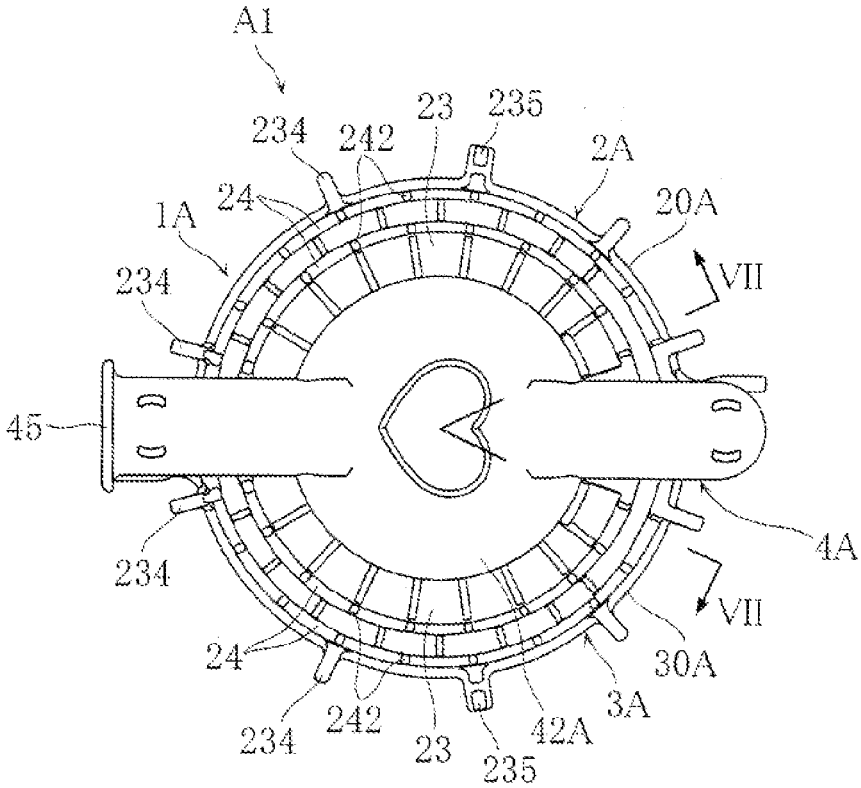
FIG. 5 is a front view of the pompon making tool shown in FIG. 4.

As shown in FIGS. 2, 3 and 5, the arcuate portions 20A, 30A each include a base plate portion 23 and a pair of thread support portions 24. In the front view of the pompon making tool A, the base plate portion 23 is generally arcuate (see FIG. 5). The pair of thread support portions 24 is erected on and extends from the base plate portion 23 toward the outer side (right side in FIG. 2, farther away from the second member 1B). The thread support portions 24 each are of a curved shape having a generally arcuate cross-section (section cut along a plane orthogonal to the direction of X1-X2). The paired thread support portions 24 are spaced apart from each other by a predetermined distance radially of the arcuate portions 20A, 30A, i.e., provided on the inner side and the outer side.

Figure 11:
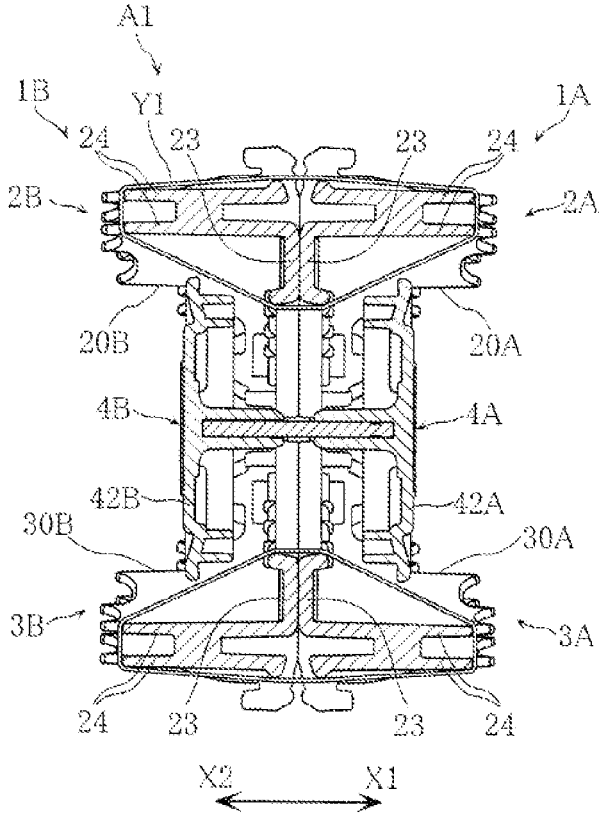
FIG. 11 is a cross-sectional view taken in the same way as FIG. 6, showing a step in a making process of the pompon.
Figure 12:
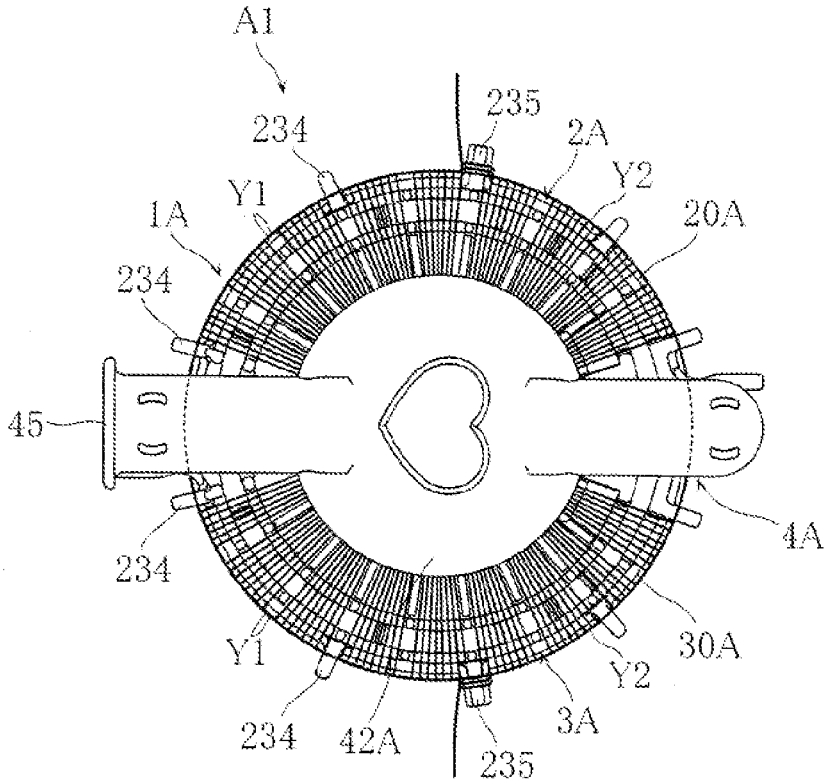
FIG. 12 is a front view showing a step in the making process of the pompon.

The base plate portion 23 and the pair of thread support portions 24 constituting each arcuate portion 20A, 30A are the parts on which a thread is wound when making a pompon (see FIG. 11). As is apparent from FIGS. 1, 2, and 7, the height H of the thread support portions 24 from the base plate portion 23 to a top portion or edge 241 is not constant, but made different according to a position in the longitudinal direction of the arcuate portions 20A, 30A (circumferential direction of the ring formed by the two arcuate portions). The difference in height H is arranged in consideration of a finished shape of the pompon to be made by the pompon making tool A1. The difference in height H creates a difference in distance L from the inner periphery of the base plate portion 23 to the outer periphery thereof via the top portions 241 of the pair of thread support portions 24 (indicated by broken lines in FIGS. 2 and 7), according to the position in the longitudinal direction. Where the height H is relatively high the distance L is relatively long, and where the height H is relatively low the distance L is relatively short.

The top portion 241 of each thread support portion 24 is formed with a plurality of projections 242 sticking out in the height direction of the thread support portion 24. In this embodiment, each of the projections 242 is located on a boundary at which the height H changes, in the longitudinal direction of the thread support portion 24.

Figure 7:
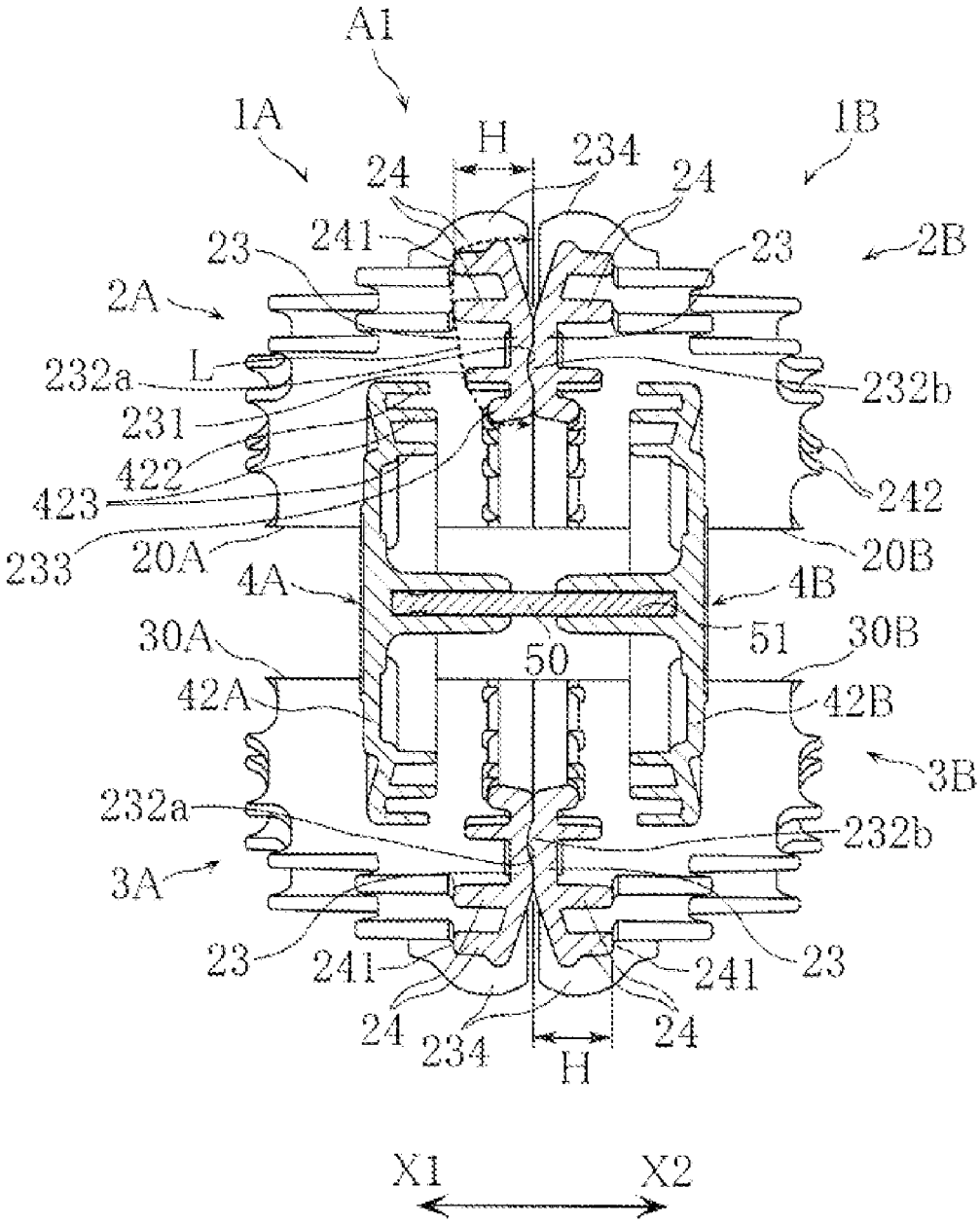
FIG. 7 is a cross-sectional view taken along lines VII-VII in FIG. 5.

As shown in FIG. 7, on the outer face of the base plate portion 23, a projecting piece 231 is provided so as to protrude in the direction X1-X2 in which the first member 1A and the second member 1B face each other, at a predetermined position radially closer to the inner periphery. The projecting piece 231 is located at a position corresponding to where the height H of the thread support portion 24 is relatively low.

Also as shown in FIG. 7, on the inner face of the base plate portion 23 of the respective arcuate portions 20A, 30A, a recessed portion 232*a* is provided at a predetermined position. The function of the recessed portion 232*a* will be described later.

As shown in FIGS. 2 and 7, an annular rib 233 protruding in the direction X1-X2 is provided on the base plate portion 23 at a position close to the inner periphery.

As shown in FIGS. 1 and 3, the arcuate portions 20A, 30A each include, on the outer periphery thereof, a plurality of guide projections 234 spaced apart from each other in the longitudinal direction. The arcuate portions 20A, 30A each include also a hook portion 235 formed on the outer periphery thereof. The function of the guide projections 234 and the hook portion 235 will be described later.

The support member 4A is, for example, made of the same synthetic resin constituting the arms 2A, 3A and, as is apparent from FIG. 3, includes a generally circular flange portion 42A located at the middle between the shaft portions 40 and 41 and extending orthogonally to the direction X1-X2. As shown in FIG. 2, the flange portion 42A is formed such that a clearance 60 is defined between the outer periphery of the flange portion 42A and the inner one of the paired thread support portions 24 of the arcuate portion 20A, 30A when the pair of arms 2A, 3A are brought close to each other so as to join the arcuate portions 20A, 30A in a ring shape. In this state, the inner face of the flange portion 42A faces the base plate portion 23 in the direction X1-X2, via a clearance 61.

Referring to FIGS. 1 and 3, the support member 4A includes a foot portion 45 formed at a longitudinal end thereof. As will be described later, locating the foot portion 45 at a lowermost position enables erecting upright the pompon making tool A1, with the first member 1A and the second member 1B coupled.

As shown in FIGS. 2 and 7, the flange portion 42A includes an annular rib 423 formed on the inner face thereof and protruding in the direction X1-X2. The rib 423 is located at a position corresponding to the rib 233 provided on the base plate portion 23 of the arcuate portions 20A, 30A.

As shown in FIG. 7, the flange portion 42A also includes, on its inner face, a projecting piece 422 sticking out in the direction X1-X2. The projecting piece 422 is located at a position corresponding to where the height H of the thread support portion 24 is relatively low.

The shaft 50 is made of a hard metal, and has a diameter of, for example, about 1 mm. As shown in FIG. 2, the shaft 50 sticks forward out of a boss 421*a* provided on the flange portion 42A, with an end thereof fixed in the boss 421*a*. The shaft 50 is provided so as to be located substantially at the center of a space defined by the arcuate portions 20A and 30A when the arcuate portions 20A and 30A are joined together in a ring shape.

The second member 1B is different in structure from the first member 1A in that the support member 4B is not provided with the shaft 50, but instead provided with a bore 51. However, the basic structure of the remaining portions of the second member 1B is the same as that of the first member 1A. Specifically, the second member 1B includes a pair of arms 2B, 3B and a support member 4B. Each of the arms 2B, 3B includes an arcuate portion 20B, 30B of a semicircular arch shape and assisting portions 21*b*, 22*b* or assisting portions 31*b*, 32*b* integrally connected to opposite ends of the arcuate portion. The support member 4B includes shaft portions 43, 44 each of which supports an end of the arm 2B or 3B so as to enable rotation in the direction indicated by arrow N3 or N4 in FIG. 3, and a flange portion 42B (see FIG. 2). The foregoing parts of the second member 1B are of the same configuration as those of the first member 1A, except that the parts of the second member 1B are vertically symmetrical to those of the first member 1A. Accordingly, as shown in FIGS. 2 and 7, the arcuate portions 20B, 30B each include a base plate portion 23 and a pair of thread support portions 24, and the height H of the thread support portions 24 from the base plate portion 23 to the top portion or edge 241 is made different according to a position in the longitudinal direction, such that the arcuate portions 20B, 30B assume a vertically symmetrical form to the arcuate portions 20A, 30A. Also, the base plate portion 23 of the arcuate portions 20B, 30B includes a protruding portion 232*b* at a predetermined position on the inner face thereof.

Figure 6:
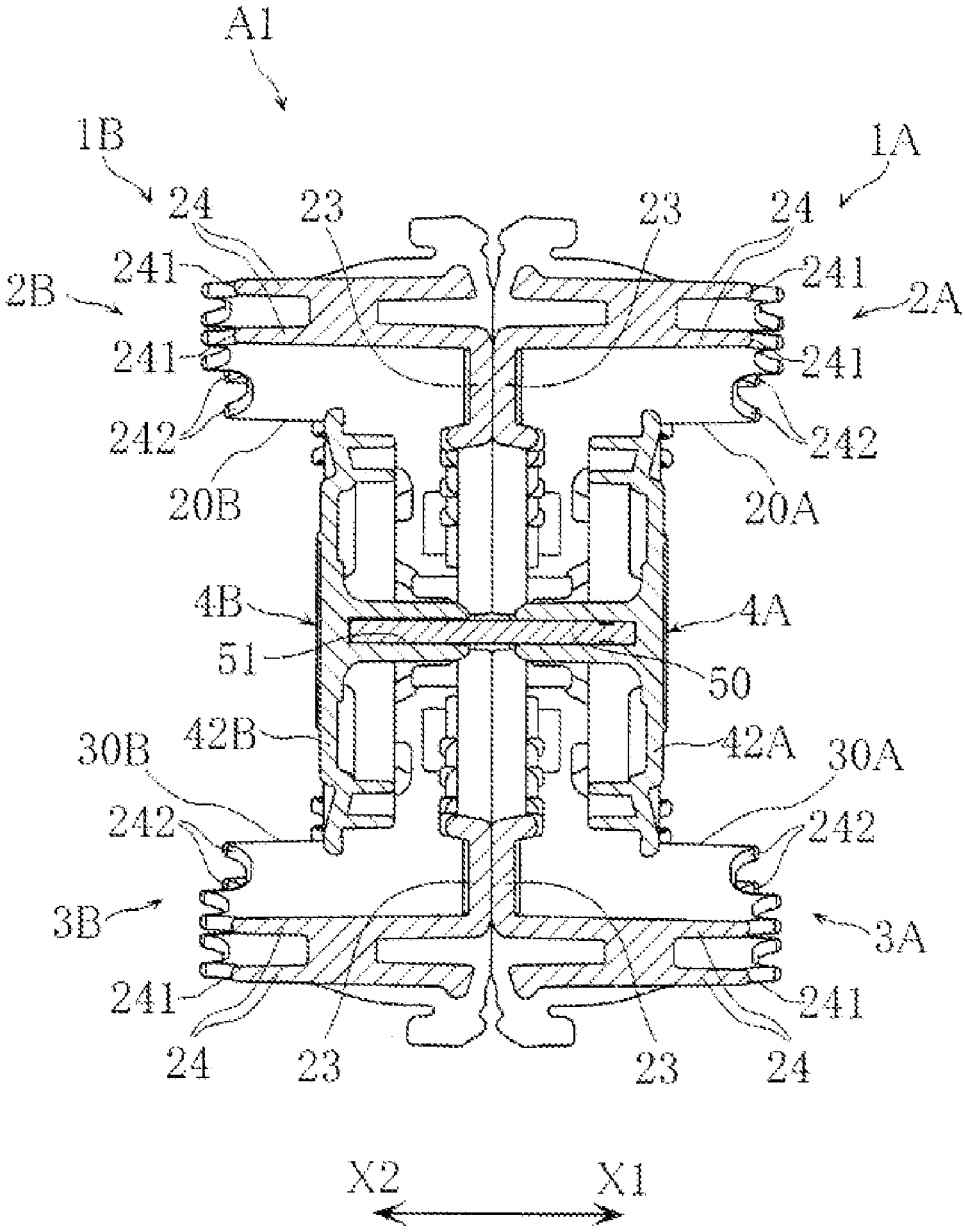
FIG. 6 is a cross-sectional view taken along lines VI-VI in FIG. 4.

The bore 51 of the second member 1B serves, once the front end of the shaft 50 is fitted therein, to detachably couple the first member 1A and the second member 1B to each other. As shown in FIG. 2, the bore is located in a boss 421*b* of a flange portion 42B of the support member 4B. As shown in FIGS. 6 and 7, when the front end of the shaft 50 is fitted in the bore 51, the arm 2A comes into contact with the arm 2B, and the arm 3A with the arm 3B, so that the corresponding parts of the first member 1A and the second member 1B face each other.

Thus, when the first member 1A and the second member 1B are superposed on each other and coupled together such that the corresponding parts of the first member 1A and the second member 1B face each other, the recessed portion 232*a* formed on the arms 2A, 3A of the first member 1A and the protruding portion 232*b* formed on the arms 2B, 3B of the second member 1B are fitted to each other, whereby positioning of the arm 2A relative to the arm 2B, and of the arm 3A relative to the arm 3B is achieved.

With the pompon making tool A thus configured, a pompon can be made as follows.

Figure 4:
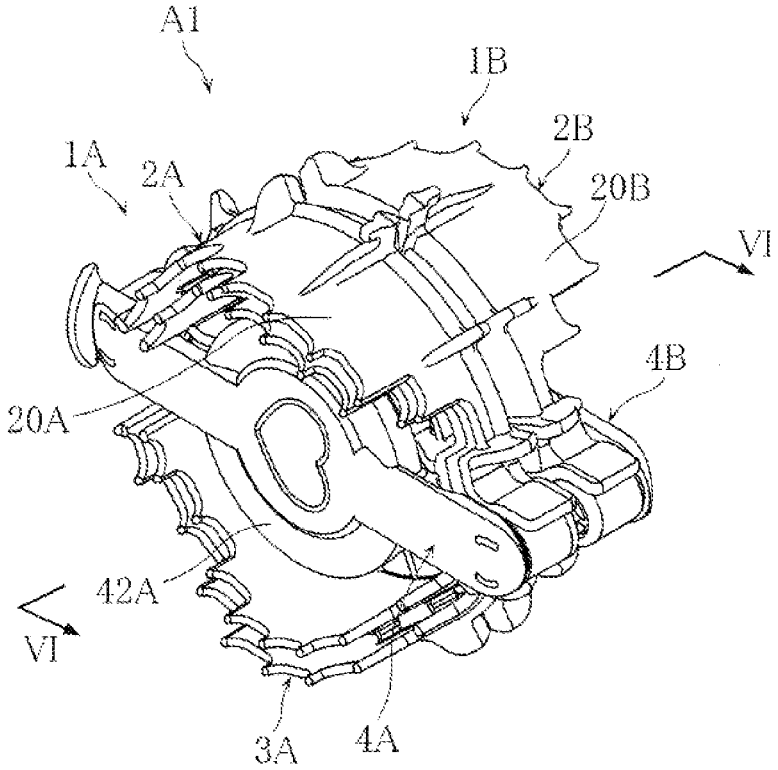
FIG. 4 is a perspective view showing the pompon making tool of FIG. 1, with a first member and a second member superposed on each other.
Figure 8:
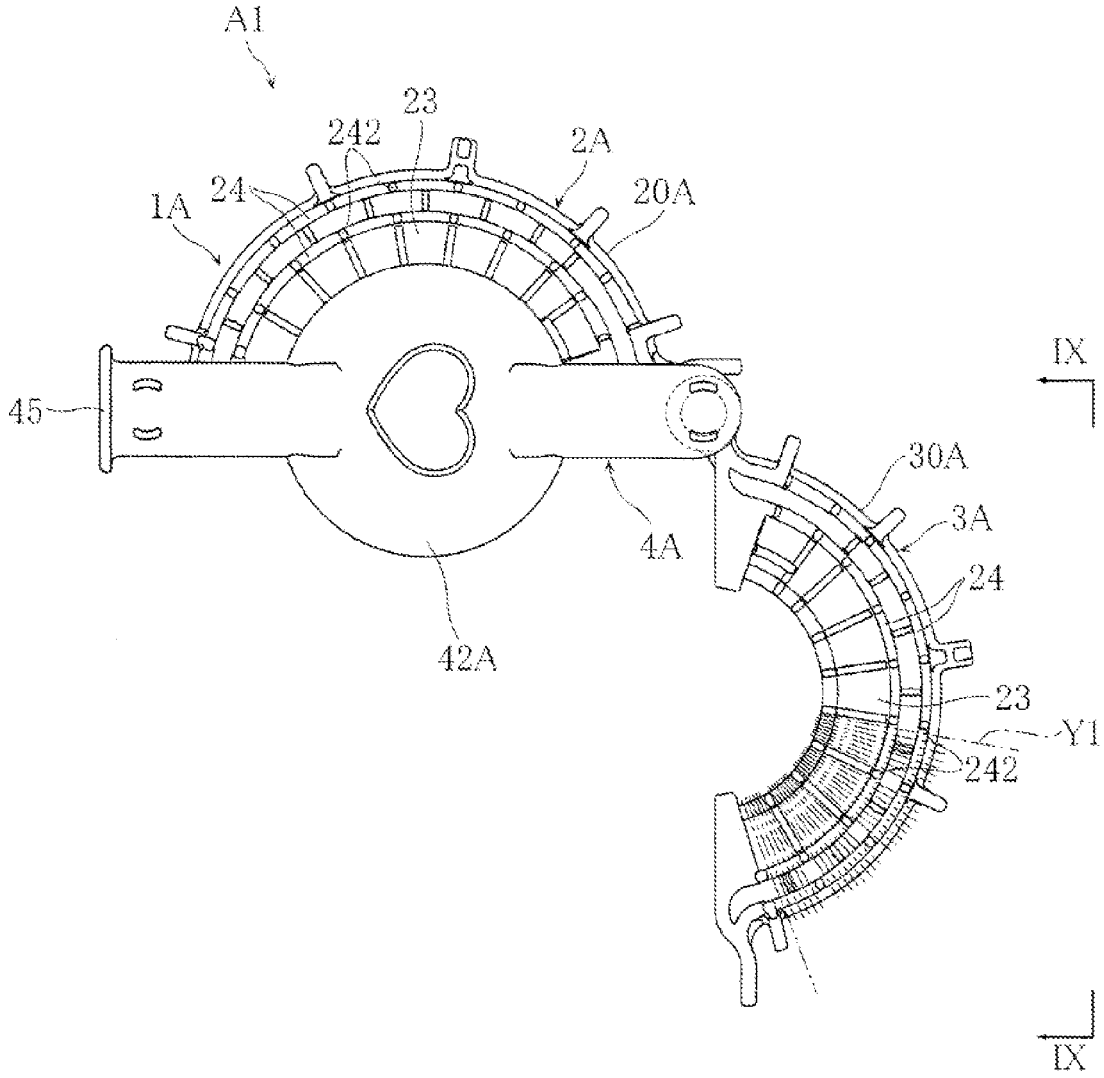
FIG. 8 is a front view showing a step in a making process of a pompon.
Figure 9:
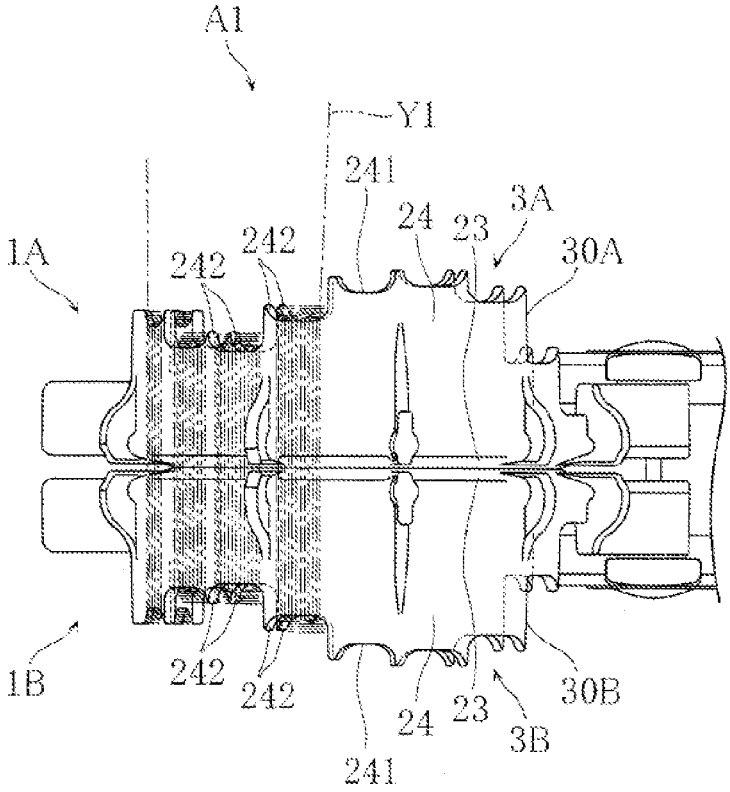
FIG. 9 shows the pompon making tool viewed along arrows IX-IX in FIG. 8.

First, as shown in FIGS. 4 and 6, the first member 1A and the second member 1B are superposed on each other and coupled together. This coupling can be easily achieved by fitting the shaft 50 into the bore 51. Then as shown in FIGS. 8 and 9, the arms 3A and 3B, which overlap in the thickness direction, are pulled outward from between the support members 4A and 4B, and a thread Y1 is wound about the arcuate portions 30A and 30B. Here, as already described referring to FIG. 7, since the recessed portion 232*a* and the protruding portion 232*b* on the respective base plate portions 23 are fitted to each other, the arcuate portions 30A and 30B are properly positioned relative to each other. Such structure prevents accidental positional shift of the arcuate portions 30A, 30B from each other, thereby facilitating the winding work of the thread Y1 about the arcuate portions 30A, and 30B.

Since the arcuate portions 30A, 30B each include the base plate portion 23 and the pair of thread support portions 24 including the top portion 241 located on the outer side of the base plate portion 23, the thread Y1 is wound so as to surround the base plate portions 23 overlapping each other and one pair each of the thread support portions 24 spaced apart from those base plate portions 23. This makes the one turn length of the thread Y1 around the arcuate portions 20A, 20B relatively long, which is advantageous for suppressing an increase in size of the pompon making tool A1.

The thread Y1 is wound about the arcuate portions 30A, 30B by such number of turns that allows the front end of the projections 242 to be slightly exposed on each thread support portion 24 of the arcuate portions 30A, 30B. Such arrangement facilitates the thread Y1 to be wound about the arcuate portions 30A, 30B in an appropriate amount in each longitudinally divided region, thereby contributing to the achievement of a neat appearance of the pompon to be made. Also, each projection 242 is located at the boundary at which the height H of the thread support portion 24 changes. Accordingly, the thread Y1 wound about the arcuate portions 30A, 30B is prevented from deviating longitudinally beyond the boundary, so that the thread Y1 is wound properly in each region of different height H.

Figure 10:
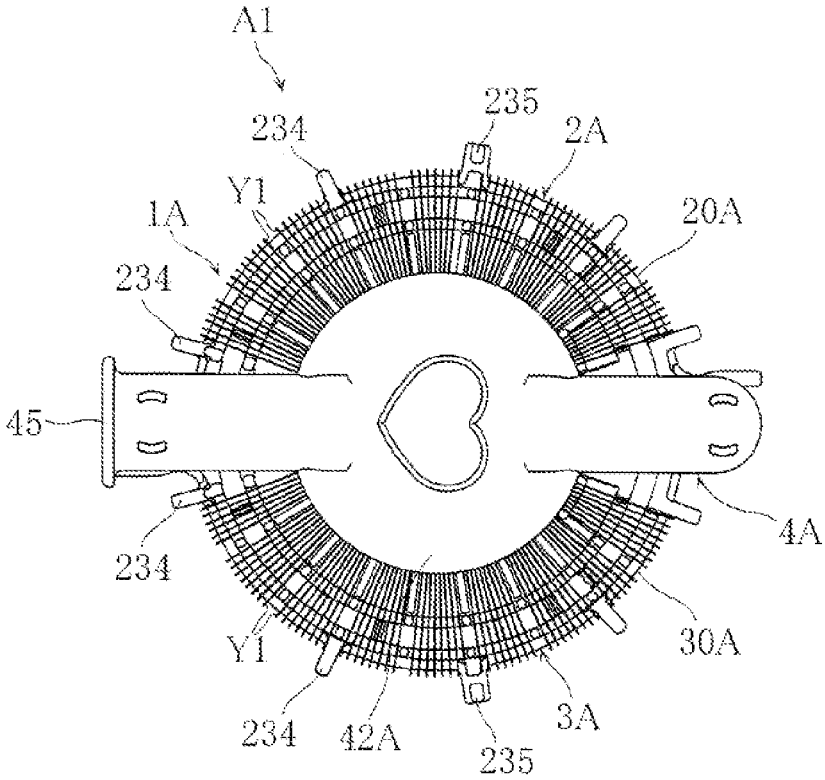
FIG. 10 is a front view showing a step in the making process of the pompon.

After winding the thread Y1 about the arcuate portions 30A and 30B, the arms 3A and 3B are rotated and set between the support members 4A and 4B. Thereafter, the thread Y1 is wound about the arcuate portions 20A and 20B in the same manner as about the arcuate portions 30A and 30B. Upon completing the winding of the thread Y1 about the arcuate portions 20A and 20B, the arms 2A and 2B are rotated to be set between the support members 4A and 4B. Thus, the arcuate portion 20A is joined with the arcuate portion 30A, and the arcuate portion 20B with the arcuate portion 30B respectively in a ring shape, as shown in FIGS. 10 and 11.

Figure 13:
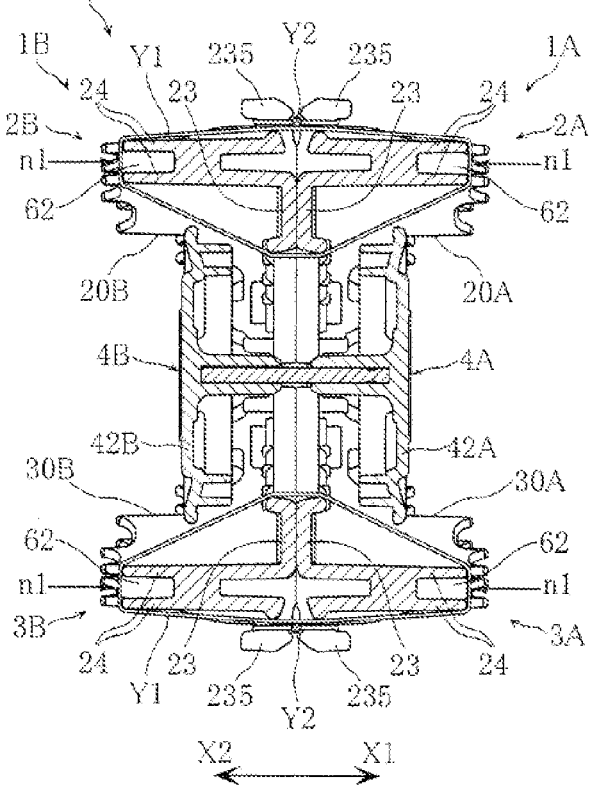
FIG. 13 is a cross-sectional view taken in the same way as FIG. 6, showing a step in the making process of the pompon.
Figure 14:
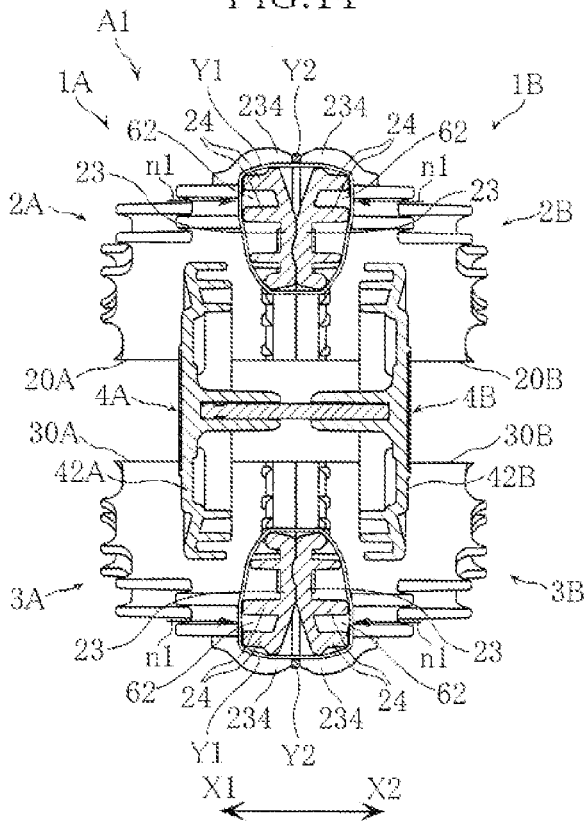
FIG. 14 is a cross-sectional view taken in the same way as FIG. 7, showing a step in the making process of the pompon.

Then as shown in FIGS. 12 to 19, another thread Y2 is wound between the arms 2A and 2B, and between the arms 3A and 3B, and the ends of the thread Y2 are wound on the hook portion 235 to fix the thread. Here, the arcuate portions 20A, 20B and the arcuate portions 30A, 30B include the guide projections 234 on the outer periphery, and a facing pair of the guide projections 234, 234 of the arcuate portions 20A and 20B define a V-shaped portion formed by respective inclined surfaces, so does a facing pair of the guide projections 239, 234 of the arcuate portions 30A and 30B. This configuration facilitates the winding of the thread Y2. Now, the thread Y2 is tightening the thread Y1 wound about the arcuate portions 20A, 20B and the arcuate portions 30A, 30B, intersecting at the center in the direction X1-X2 at a position radially close to the outer periphery of the arcuate portions. Since the ends of the thread Y2 are wound on the hook portion 235 for fastening, the thread Y2 is prevented from coming loose. The tightening by the thread Y2 can be easily performed by locating the foot portion 45 of the support member 4A, 4B at a lowermost position so as to place the pompon making tool A1 upright. In FIGS. 11, 13, 14, and in FIGS. 15 to 20 to be referred to later, the thread Y1 (Y1', Y1") is illustrated as if it were wound only one turn on the arcuate portions 20A, 20B and the arcuate portions 30A, 30B for the sake of explicitness.

Then with a pair of scissors for example, the thread Y1 is cut between the pair of thread support portions 24 (at the positions indicated by n1 in FIGS. 13 and 14). Between the pair of thread support portions 24, a groove 62 is continuously defined in the longitudinal direction, which allows easily cutting the thread Y1 simply by inserting the tip of the scissors in the groove 62.

Figure 15:
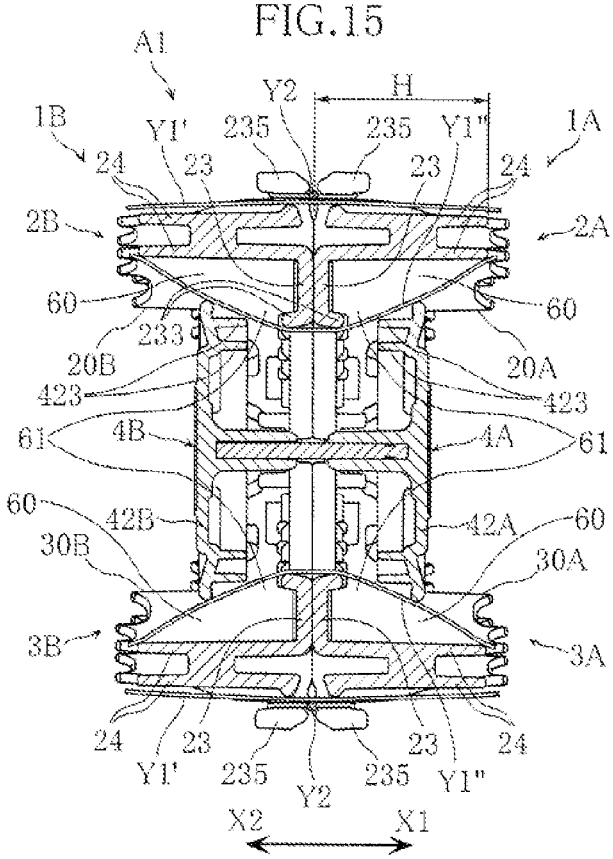
FIG. 15 is a cross-sectional view taken in the same way as FIG. 6, showing a step in the making process of the pompon.
Figure 16:
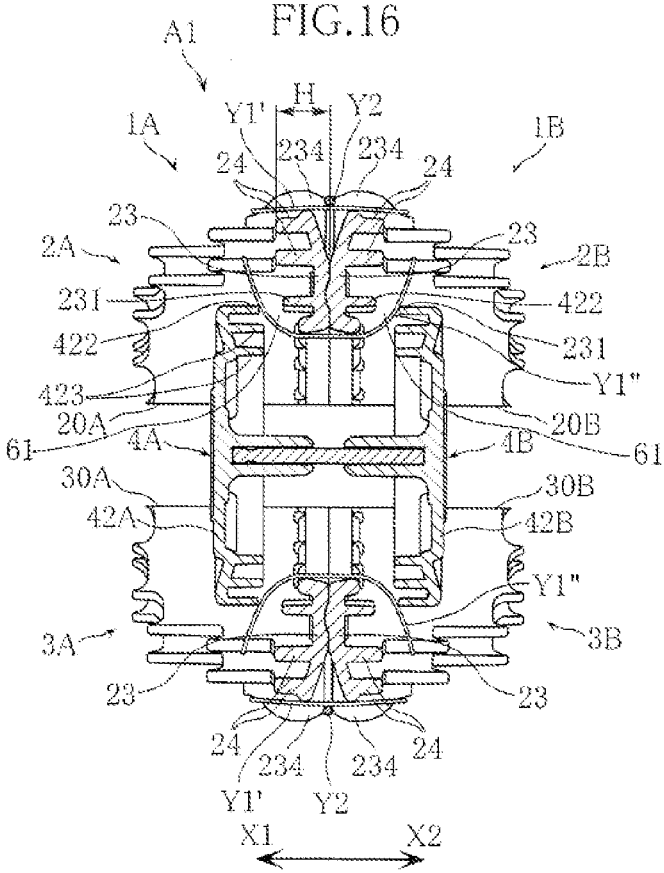
FIG. 16 is a cross-sectional view taken in the same way as FIG. 7, showing a step in the making process of the pompon.

By this cutting, the thread Y1 is split into a bundle of threads Y1' and a bundle of threads Y1", as shown in FIGS. 15 and 16. Specifically, from one turn of the thread Y1 wound about the arcuate portions 20A, 20B and the arcuate portions 30A, 30B, two threads Y1', Y1" are obtained, the thread Y1' on the outer peripheral side of the arcuate portions, and the thread Y1" on the inner peripheral side thereof. As is apparent by comparing FIG. 15 and FIG. 16, the length of the threads Y1', Y1" is relatively short, at a region where the height H of the thread support portions 24 is relatively low.

In the state shown in FIGS. 15 and 16, since the threads Y1' on the outer peripheral side of the arcuate portions are tightened by the thread Y2, the threads Y1' are kept from accidentally shifting after the thread Y1 is cut.

Also, when the thread Y1 is cut as above, the opposite ends of each thread Y1" on the inner peripheral side of the arcuate portions tend to flare out in the direction X1-X2. However, the thread Y1" is passed through the clearance 60 between the thread support portion 24 of one of the arcuate portions 20A (30A) and the outer periphery of the flange portion 42A of the support member 4A, as well as the clearance 61 between the base plate portion 23 of the arcuate portion 20A (30A) and the inner face of the flange portion 42A, and then over the inner periphery of the base plate portion 23, into the clearances 61, 60 on the mating arcuate portion 20B (30B) side. Accordingly, the thread Y1" is moderately bent and supported by the arcuate portions 20A, 20B (30A, 30B) and the flange portions 42A, 42B, and hence positional shift of the thread Y1" is also prevented. Further, the thread Y1" is in contact with the rib 233, 423, and the projecting piece 231, 422 provided so as to narrow the clearance 61. Such configuration further ensures the prevention of the positional shift of the thread Y1".

Figure 17:
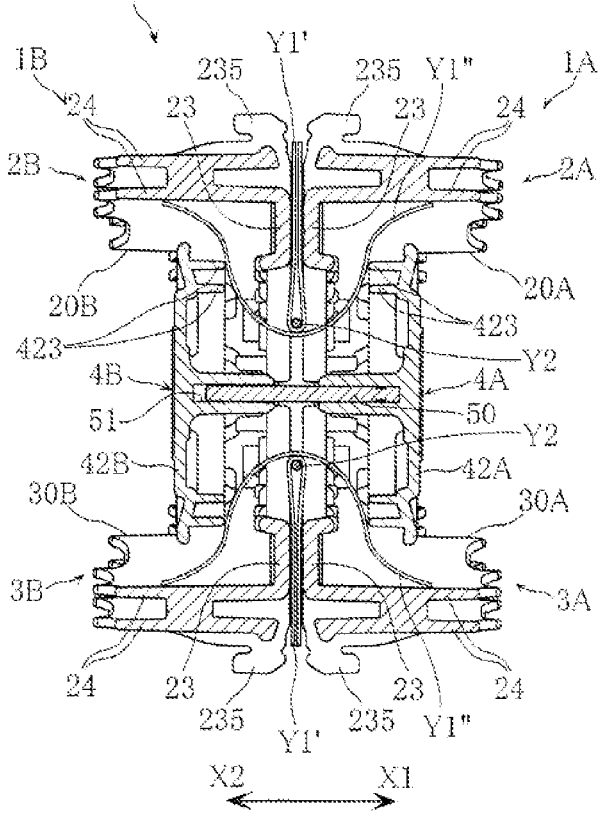
FIG. 17 is a cross-sectional view taken in the same way as FIG. 6, showing a step in the making process of the pompon.
Figure 18:
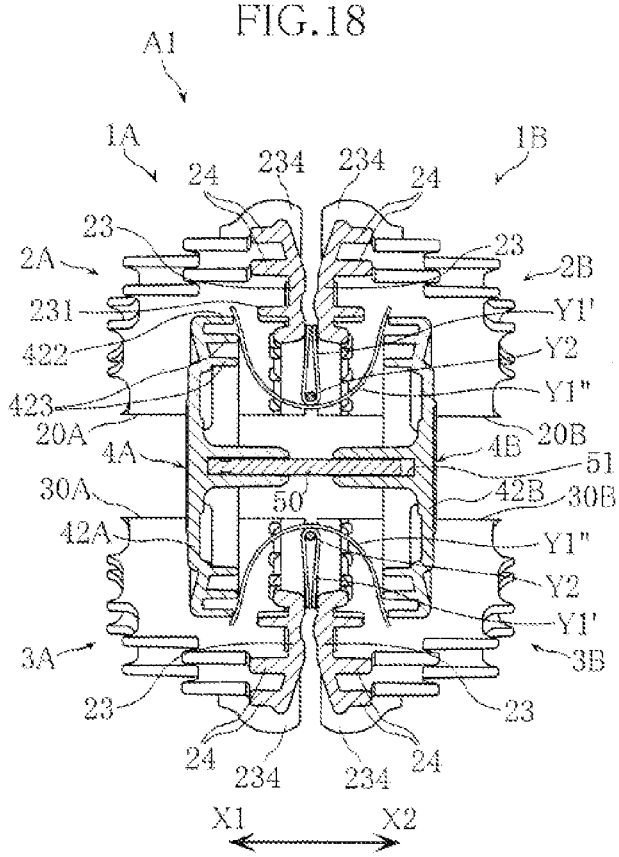
FIG. 18 is a cross-sectional view taken in the same way as FIG. 7, showing a step in the making process of the pompon.
Figure 19:
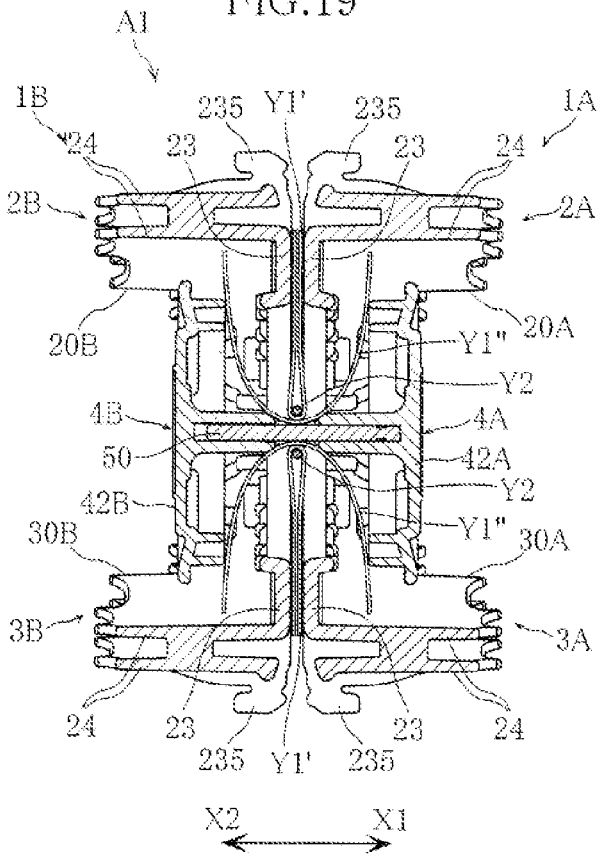
FIG. 19 is a cross-sectional view taken in the same way as FIG. 6, showing a step in the making process of the pompon.
Figure 20:
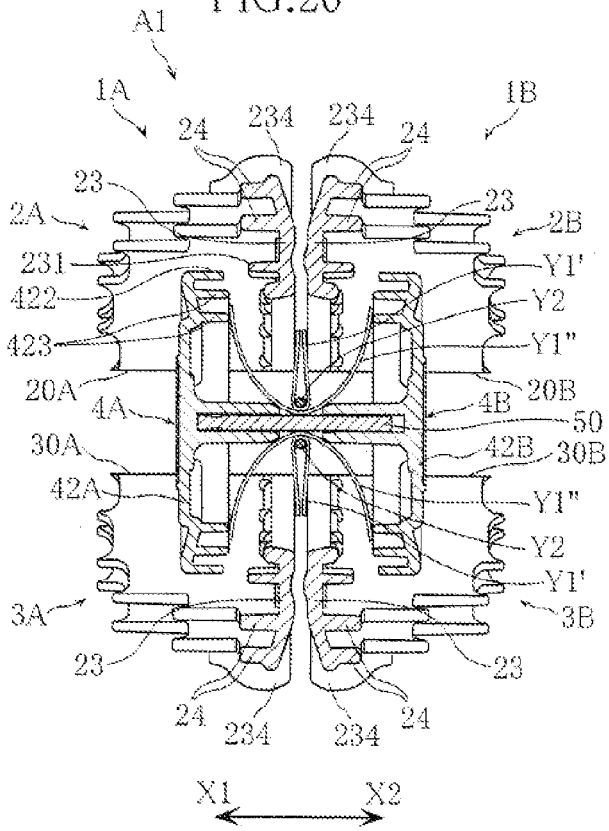
FIG. 20 is a cross-sectional view taken in the same way as FIG. 7, showing a step in the making process of the pompon.

Then the ends of the thread Y2 are removed from the hook portion 235 and tightly tied together. Specifically, as shown in FIGS. 17 to 20, the thread Y2 is utilized to tie the threads Y1', Y1" together with the shaft 50. FIGS. 17 and 18 depict a halfway process of tying the threads Y1', Y1", and FIGS. 19 and 20 depict the state where the threads Y1', Y1" have been tied. Since the first member 1A and the second member 1B are coupled merely by the insertion of the shaft 50 into the bore 51, the shaft 50 can be slid relative to the bore 51 by a small distance, and thus a clearance for the thread Y2 and the thread Y1' to enter between the first member 1A and the second member 1B can be easily obtained.

As is understood from FIGS. 17 and 19, the thread Y1" comes into contact with the rib 423 of the two flange portions 42A, 42B in the process of being tied by the thread Y2, and a resisting force acts generally uniformly to left and right. Accordingly, the thread Y1" can be tied at the center without shifting to either side in the longitudinal direction. Also, as is apparent from FIGS. 18 and 20, the relatively short ones of the threads Y1" come into contact with the projecting pieces 231, 422, in addition to the rib 423. Such arrangement properly prevents the positional shift of the thread Y1', which have relatively short length, in the tying process.

Figure 21:
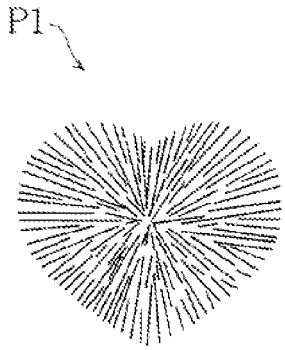
FIG. 21 is a front view showing a pompon made with the pompon making tool according to the first embodiment.

Then the arms 2A, 2B and the arms 3A, 3B are rotated to be pulled out from between the support members 4A and 4B, and the first member 1A and the second member 1B are separated by pulling out the front end of the shaft 50 from the bore 51. Then, the threads Y1', Y2', together with the thread Y2, are removed from the shaft 50. Although the threads Y1', Y1" are tied onto the shaft 50, these threads can be easily removed from the shaft 50 by sliding the threads longitudinally of the shaft 50. Then, with the thread Y2, the threads Y1', Y1" are tightly tied together so as not to come loose. Through such process, a pompon P1 having a heart-shaped appearance in a front view is obtained, as shown in FIG. 21.

Figure 22:
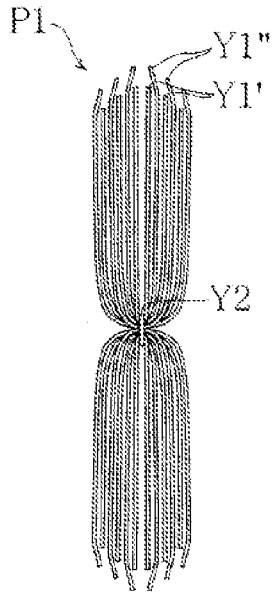
FIG. 22 shows a cross-sectional structure of the pompon made with the pompon making tool according to the first embodiment.
Figure 23:
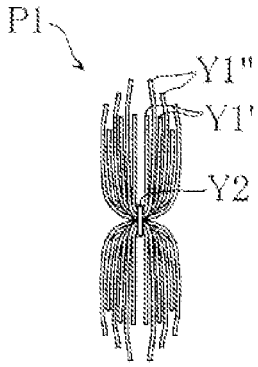
FIG. 23 shows a cross-sectional structure of the pompon made with the pompon making tool according to the first embodiment.

FIGS. 22 and 23 schematically depict a cross-sectional structure of the pompon P1. FIG. 22 represents a portion where the threads Y1', Y1" are relatively long, and FIG. 23 a portion where the threads Y1', Y1" are relatively short. As is understood from these drawings, the threads Y1', Y1" are folded back at the center and densely bundled, so that the pompon P1 assumes a relatively flat shape having higher density in a predetermined direction.

Figure 24:
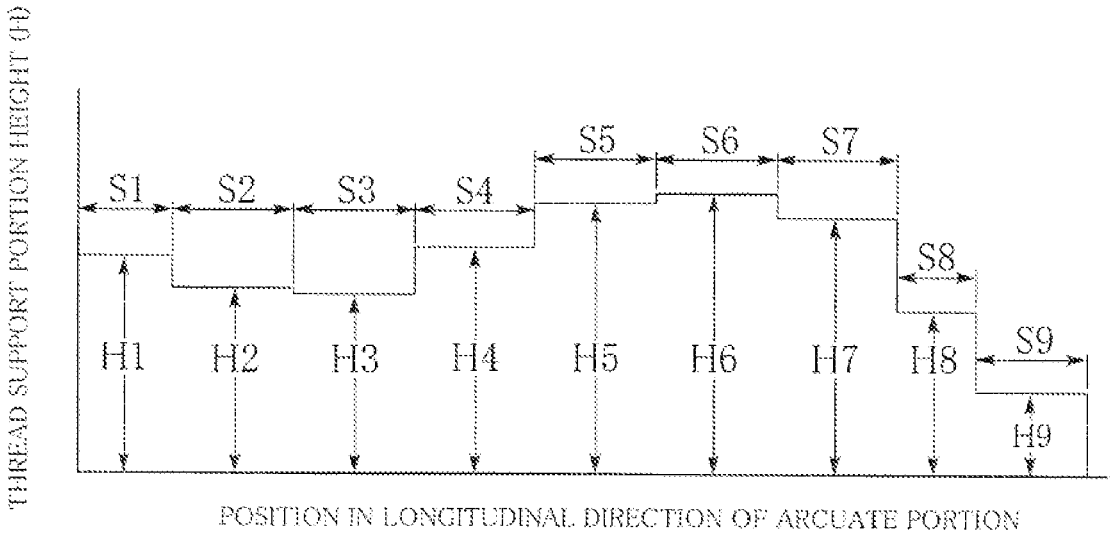
FIG. 24 is a diagram for explaining the function of the pompon making tool according to the first embodiment.
Figure 25:
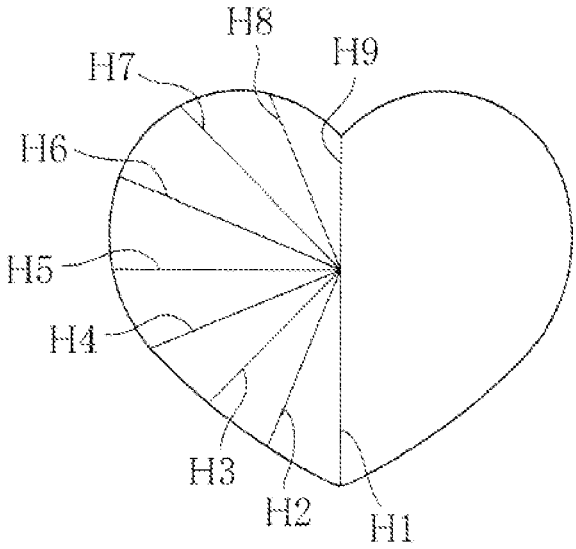
FIG. 25 is another diagram for explaining the function of the pompon making tool according to the first embodiment.

FIG. 24 indicates the height H (H1 to H9) of the thread support portion 24 at the respective positions along the longitudinal direction of the arcuate portion, assuming that the arcuate portion 20A of the arm 2A is linearly extended longitudinally. The height H (H1 to H9) of the thread support portion 24 is thus different according to the position along the longitudinal direction. The difference among the heights H1 to H9 is, as is apparent from FIG. 25, arranged in correspondence with the intended difference in dimension of the pompon P1 from the center to the periphery, along the circumferential direction. Designing thus the heights H1 to H9 enables making the pompon P1 having the heart-shaped appearance in a front view.

Also, as shown in FIG. 24, in the thread support portion 24, the regions having different heights H (H1 to H9) have different dimensions S (S1-S9) in the longitudinal direction. As a tendency, a region having a relatively large height H has a relatively large longitudinal dimension S. When the longitudinal dimension S is constant, the density of the threads Y1', Y1" is prone to differ with portions in the pompon P1 obtained. In contrast, properly giving a difference in longitudinal dimension S according to the variation in height H ensures that uniform density of the threads Y1', Y1" is obtained in the pompon P1. This is advantageous from the viewpoint of the appearance of the pompon P1 to be obtained.

FIGS. 26 to 31 illustrate variations of the pompon making tool according to the present invention. In these drawings, the elements which are identical or similar to those of the first embodiment are given the same reference signs, and the description is appropriately omitted.

Figure 26:
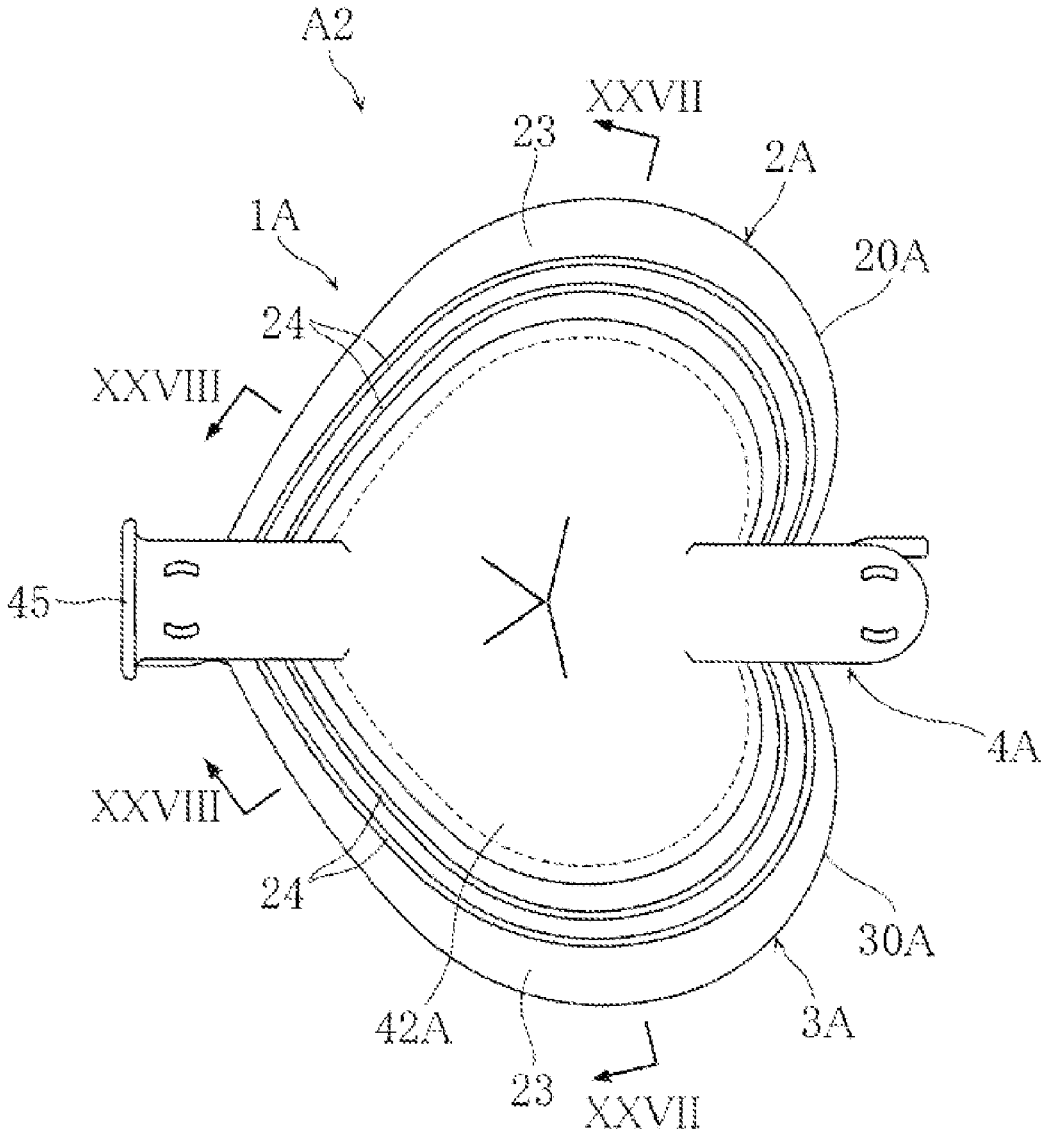
FIG. 26 is a front view showing a pompon making tool according to a second embodiment of the present invention.
Figure 27:
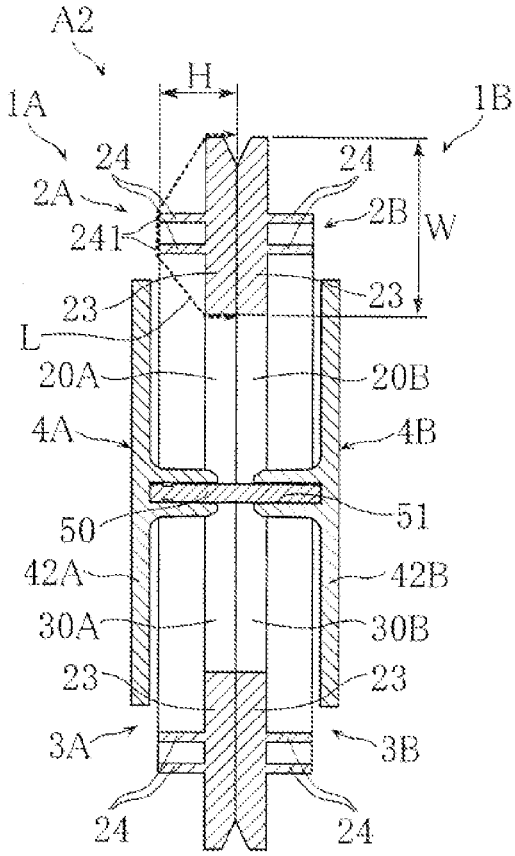
FIG. 27 is a cross-sectional view taken along lines XXVII-XXVII in FIG. 26.
Figure 28:
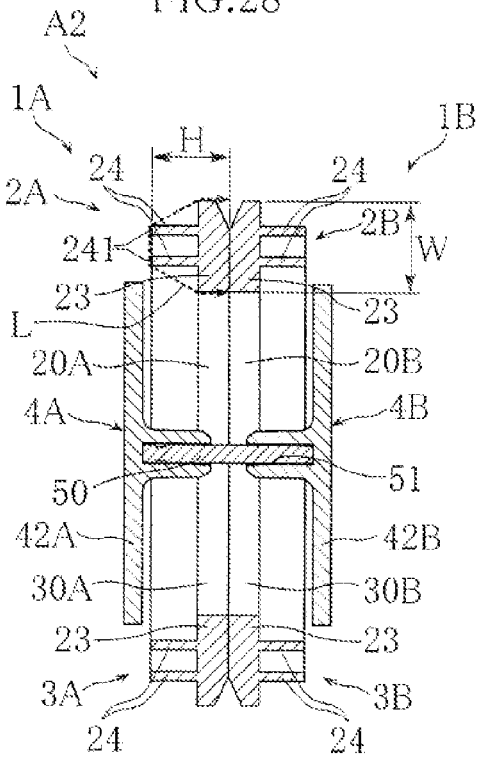
FIG. 28 is a cross-sectional view taken along lines XXVIII-XXVIII in FIG. 26.

FIGS. 26 to 28 illustrate a pompon making tool A2 according to a second embodiment of the present invention. In the pompon making tool A2, the arcuate portions 20A, 30A (20B, 30B) are of a heart shape split in half. The pair of thread support portions 24 has a constant height H irrespective of the position in the longitudinal direction of the arcuate portions 20A, 30A (20B, 30B). On the other hand, the width W of the base plate portion 23 from the inner periphery to the outer periphery varies according to the position in the longitudinal direction. Such configuration creates a difference in distance L from the inner periphery of the base plate portion 23 to the outer periphery thereof via the top portions 241 of the pair of thread support portions 24, according to the position in the longitudinal direction of the arcuate portions 20A, 30A (20B, 30B). Specifically, in the pompon making tool A2, the width W of the base plate portion 23 of the arcuate portions 20A, 30A (20B, 30B) is set to vary, according to the position in the longitudinal direction, so as to make a heart-shaped pompon. The process of making the pompon using the pompon making tool A2 is the same as that described in the first embodiment. With the pompon making tool A2 thus configured, a relatively flat pompon having a heart shape in a plan view can be obtained.

Figure 29:
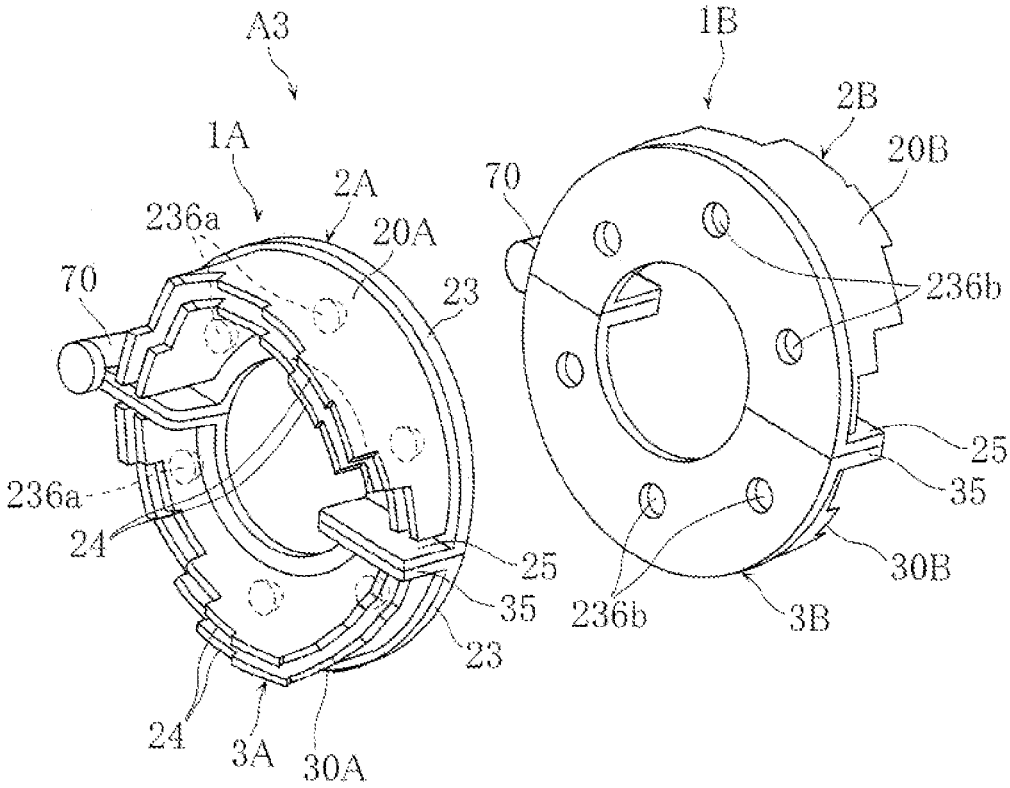
FIG. 29 is a perspective view showing a pompon making tool according to a third embodiment of the present invention.
Figure 30:
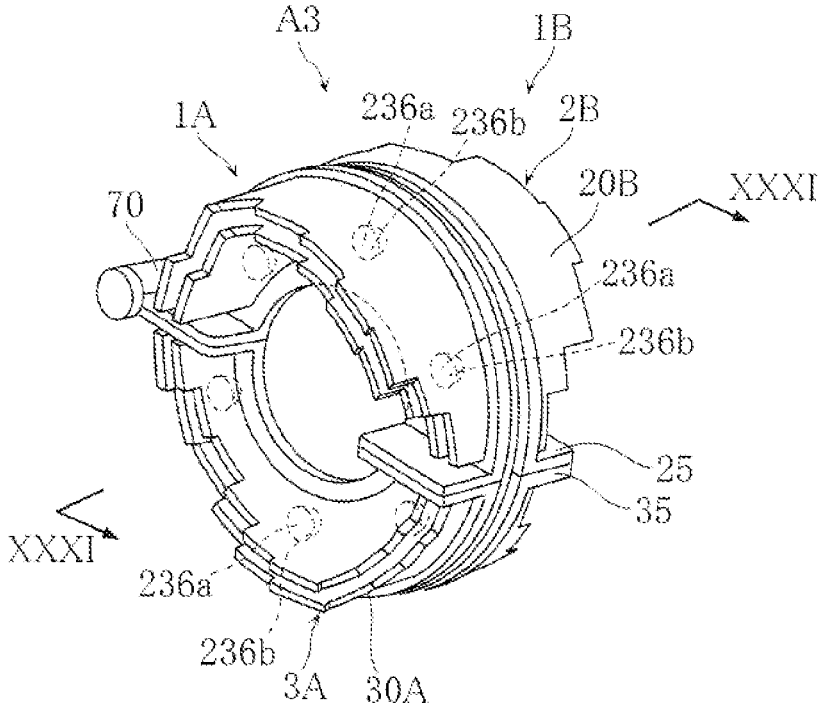
FIG. 30 is a perspective view showing the pompon making tool of FIG. 29, with a first member and a second member superposed on each other.
Figure 31:
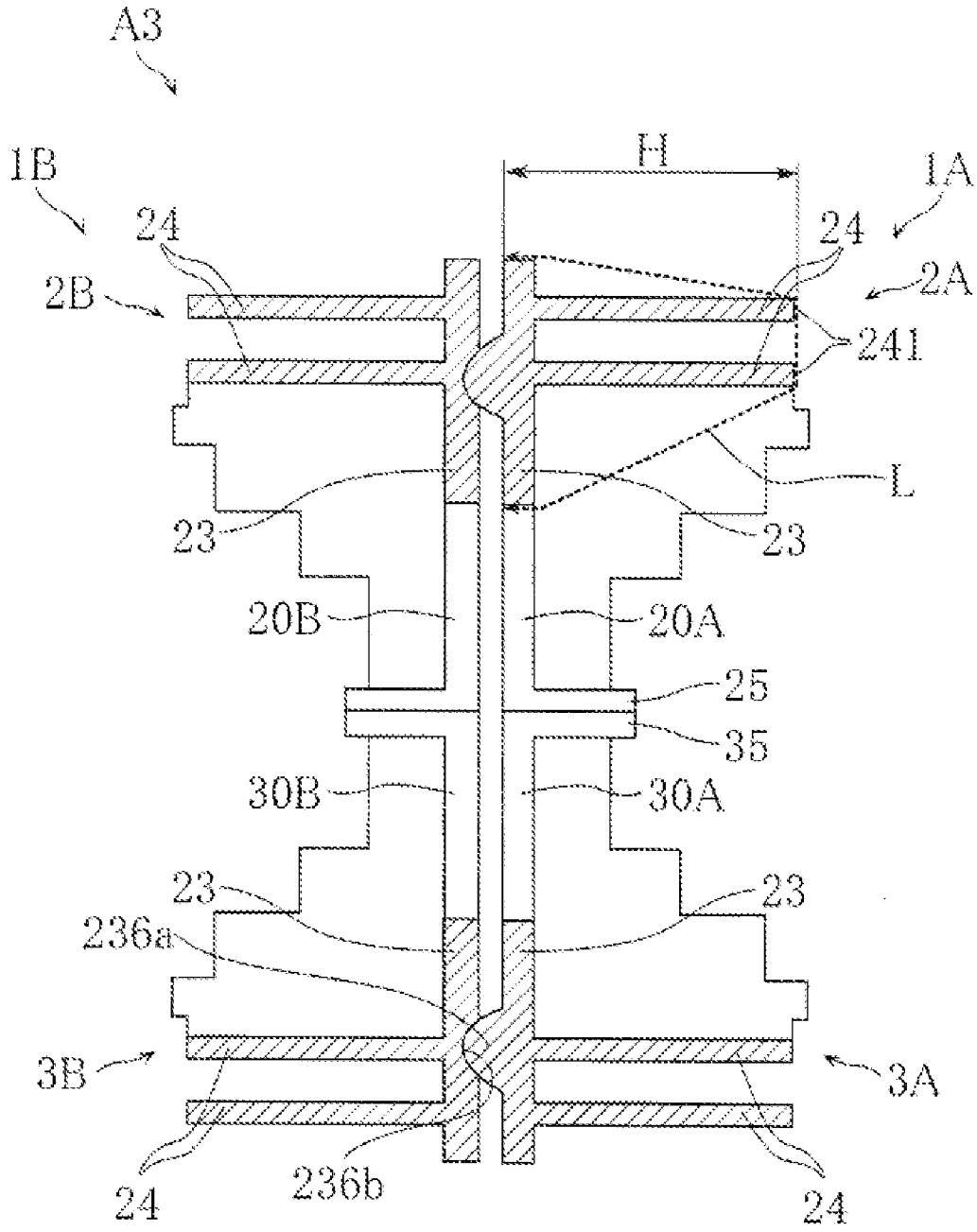
FIG. 31 is a cross-sectional view taken along lines XXXI-XXXI in FIG. 30.
Figure 32:
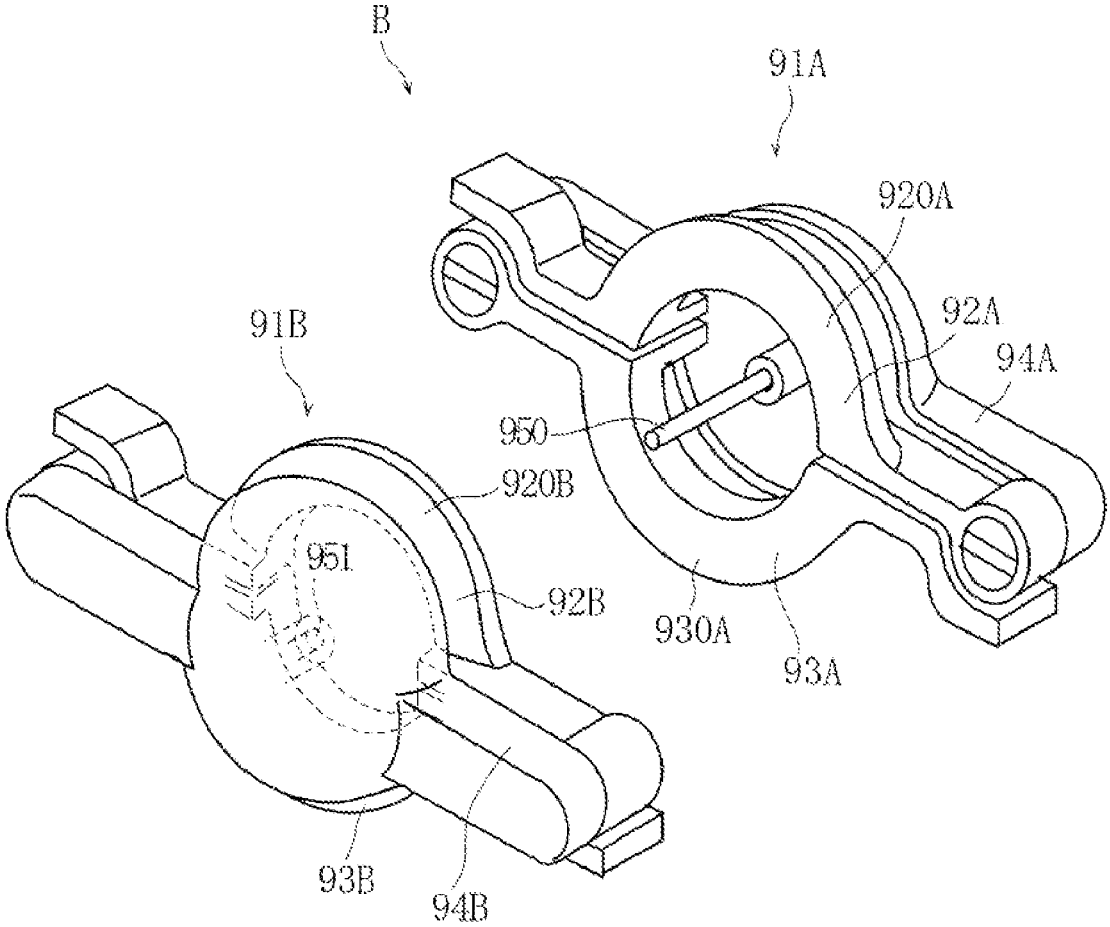
FIG.32 PRIOR ART
FIG. 32 is a perspective view showing a conventional pompon making tool.
Figure 33:
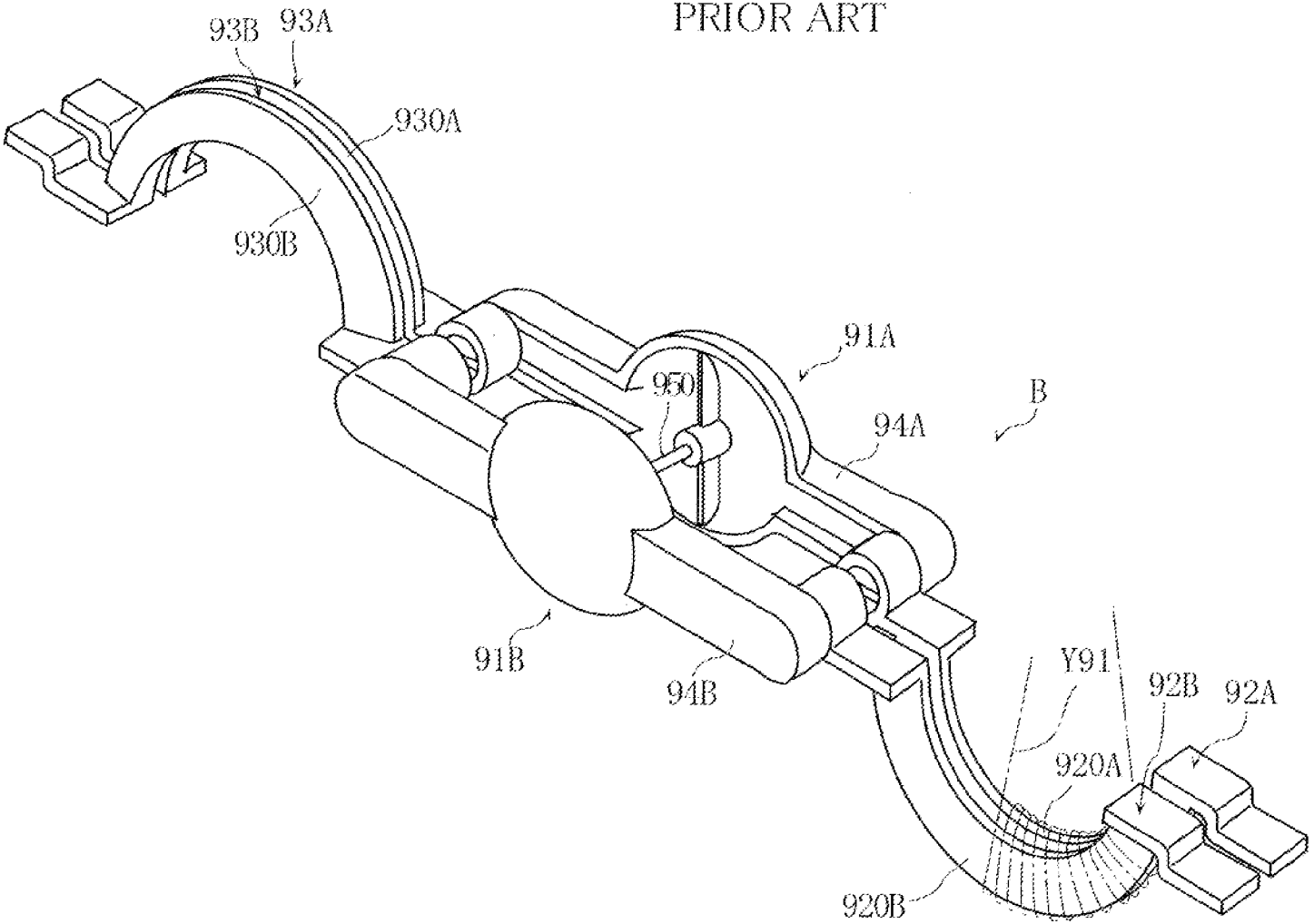
FIG. 33 PRIOR ART
FIG. 33 is a perspective view showing a step in a making process of a pompon with the conventional pompon making tool.
Figure 34:
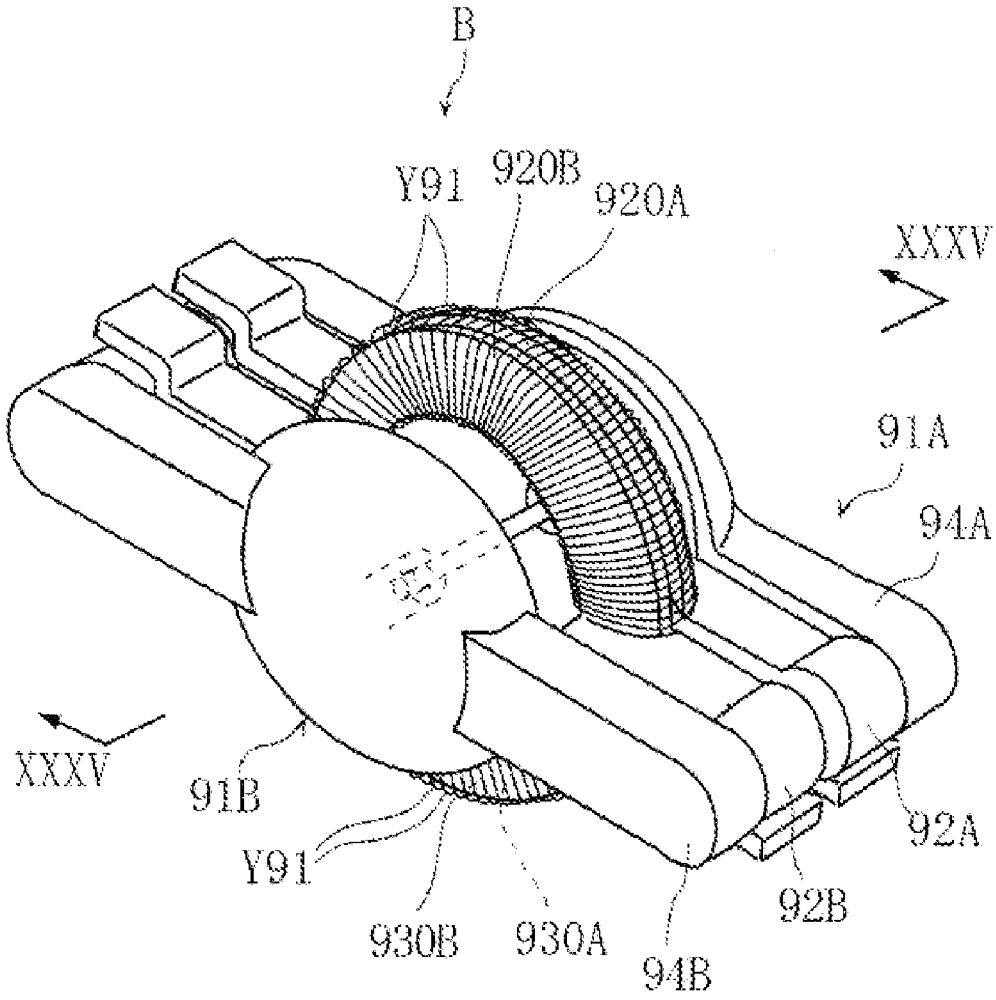
FIG.34 PRIOR ART
FIG. 34 is a perspective view showing a step in the making process of the pompon with the conventional pompon making tool.
Figure 35:
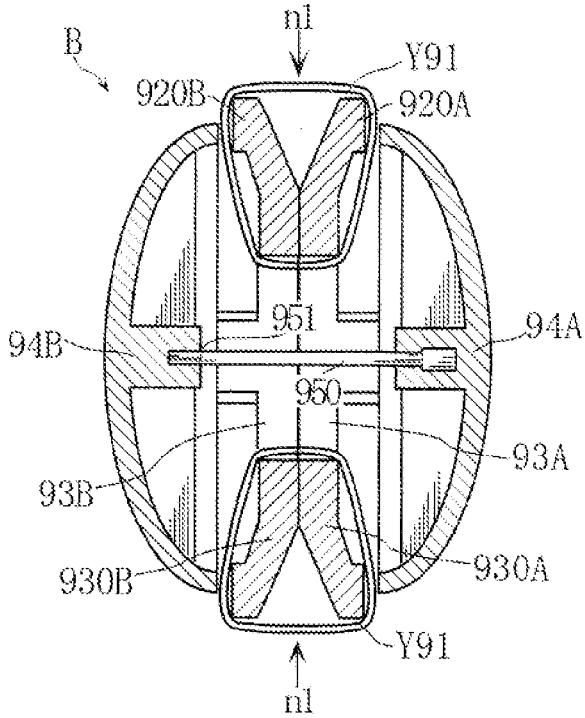
FIG.35 PRIOR ART
FIG. 35 is a cross-sectional view taken along lines XXXV-XXXV in FIG. 34.
Figure 36:
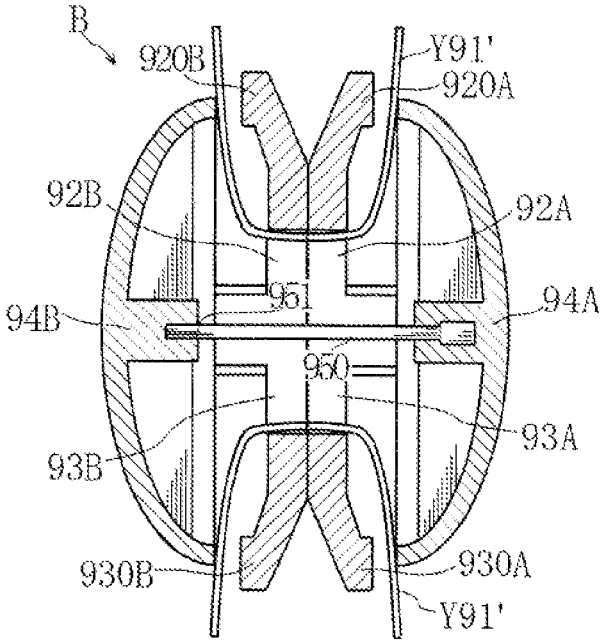
FIG.36 PRIOR ART
FIG. 36 is a cross-sectional view showing a step in the making process of the pompon with the conventional pompon making tool.
Figure 37:
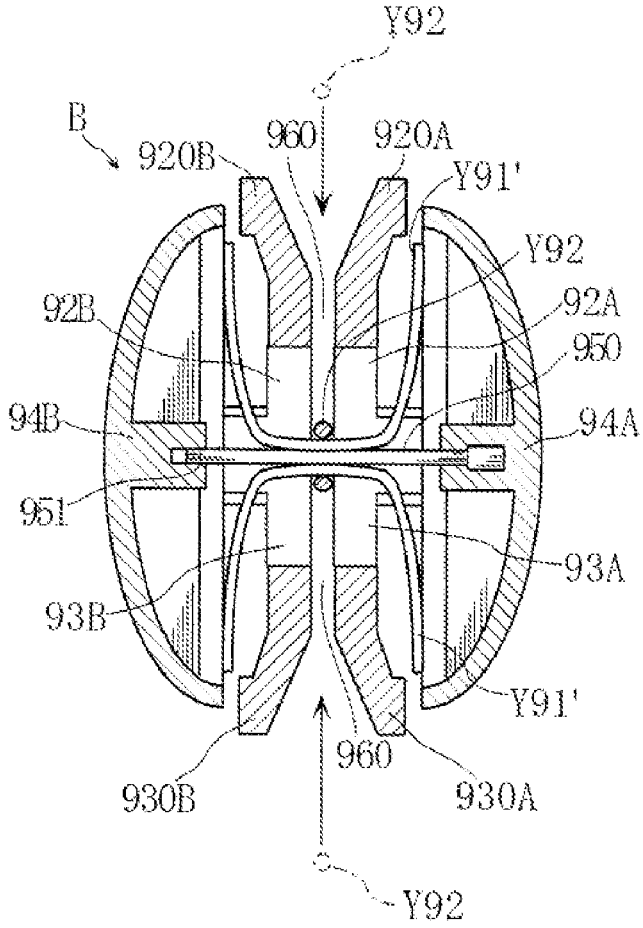
FIG.37 PRIOR ART
FIG. 37 is a cross-sectional view showing a step in the making process of the pompon with the conventional pompon making tool.
Figure 38:
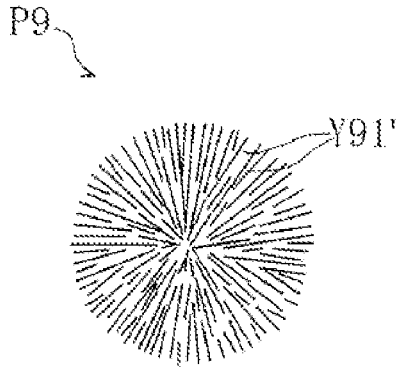
FIG.38 PRIOR ART
FIG. 38 illustrates the pompon made with the conventional pompon making tool.

FIGS. 29 to 31 depict a pompon making tool A3 according to a third embodiment of the present invention. The pompon making tool A3 is different from the pompon making tool A1 of the first embodiment in that the support members 4A, 4B are omitted. The pair of arms 2A, 3A (2B, 3B) are pivotally connected at a respective end, for example via a hinge portion 70. On the respective other end of the pair of arms 2A, 3A (2B, 3B) a flange 25, 35 is provided. When the flanges 25, 35 are brought into contact with each other, the pair of arms 2A, 3A (2B, 3B) can be joined together in a ring shape. Each of the arcuate portions 20A, 30A, 20B, 30B is of the semicircular arch shape as in the pompon making tool A1, and includes a base plate portion 23 and a pair of thread support portions 24. Also, giving an appropriate rotational resistance to the hinge portion 70 allows the pair of arms 2A, 3A (2B, 3B) to be properly maintained in a desired positional relationship.

The first member 1A includes a plurality of protruding portions 236*a* on the inner face of the arcuate portions 20A, 30A. The second member 1B includes a plurality of recessed portions 236*b* on the inner face of the arcuate portions 20B, 30B. As shown in FIGS. 30 and 31, when the first member and the second member are superposed on each other, the recessed portions 236*b* and the protruding portions 236*a* are fitted to each other, and thereby the positioning between the arms 2A, 2B and between the arms 3A, 3B is achieved.

Similarly to the pompon making tool A1, the height H of the thread support portions 24 from the base plate portion 23 to the top portion 241 is different according to the position along the arcuate portions 20A, 30A (20B, 30B). Such difference in height H creates a difference in distance L from the inner periphery of the base plate portion 23 to the outer periphery thereof via the top portions 241 of the pair of thread support portions 24, according to the position in the longitudinal direction of the arcuate portions 20A, 30A (20B, 30B). In the pompon making tool A3, the height H is set to vary, according to the position in the longitudinal direction of the arcuate portions 20A, 30A (20B, 30B), so as to make a heart-shaped pompon. The process of making the pompon with the pompon making tool A3 is the same as that described in the first embodiment. Utilizing the pompon making tool A3 thus configured enables making a relatively flat pompon of a heart shape in a plan view.

Although the embodiments of the present invention have been described above, the present invention is in no way limited thereto. Specific shapes and materials of the pompon making tool according to the present invention are not limited to those described in the embodiments, either.

In the foregoing embodiments, the method of making differences in distance L around the cross-section of the arcuate portions, from the inner periphery of the base plate portion to the outer periphery thereof via the top portions of the pair of thread support portions, according to the position in the longitudinal direction of the arcuate portion, is exemplified by two configurations. Specifically, one of the methods is making differences in height of the thread support portion from the base plate portion to the top portion according to the position in the longitudinal direction, and the other is making differences in width of the base plate portion from the inner periphery to the outer periphery thereof, according to the position in the longitudinal direction. The method of making differences in distance from the inner periphery of the base plate portion to the outer periphery thereof via the top portions of the pair of thread support portions according to the position in the longitudinal direction of the arcuate portion is not limited to these two arrangements, but a different method may be adopted. Such arrangement of the arcuate portions allows giving appropriate differences in length per turn of the thread to be wound about the arcuate portions for making the pompon, according to the position in the longitudinal direction of the arcuate portions.

Although the foregoing embodiments exemplify the case of making the heart-shaped pompon, the pompon making tool according to the present invention may also be configured to form a pompon of different shapes. As is understood from the embodiments, in the structure where the length per turn of the thread wound about the arcuate portions for making the pompon is different according to the position in the longitudinal direction of the arcuate portions, a longer length per turn of the thread leads to a longer dimension from the center to the periphery of the pompon to be made, while a shorter length per turn of the thread leads to a shorter dimension from the center to the periphery of the pompon to be made. Utilizing such correlation enables making a pompon of another shape than the heart shape, such as a triangle or square.

The invention claimed is:

1. A pompon making tool, comprising:

a first member including a pair of arms movable relative to each other, each of the arms including an arcuate portion; and a second member to be superposed on the first member, the second member including a pair of arms movable relative to each other, each of the arms including an arcuate portion;

wherein the arcuate portions each include a base plate portion, and a pair of thread support portions spaced apart from each other in a width direction of the base plate portion, and the thread support portions each include a top portion on an outer side of the base plate portion and extend in a longitudinal direction of the arcuate portion.

2. The pompon making tool according to claim 1, wherein, in a cross section of each of the arcuate portions, a length from an inner periphery of the base plate portion to an outer periphery thereof via the respective top portions of the paired thread support portions is different according to a position in the longitudinal direction of the arcuate portion.

3. The pompon making tool according to claim 2, wherein the paired thread support portions and the base plate portion of each of the arcuate portions are arcuate in the longitudinal direction, and a height of each of the thread support portions from the base plate portion to the top portion is different according to a position in the longitudinal direction.

4. The pompon making tool according to claim 1, wherein the top portion of each of the thread support portions is provided with a plurality of projections at intervals in the longitudinal direction that project in a direction in which the first member and the second member are to be superposed on each other.

5. The pompon making tool according to claim 1, wherein the first member and the second member each include a support member that pivotally supports the paired arms so as to allow the arcuate portions of the paired arms to join together in a ring shape, and the support member of the first member and that of the second member are detachably connectable.

6. The pompon making tool according to claim 5, wherein each of the support members includes a flange portion spreading orthogonally to a direction in which the first member and the second member are to be superposed on each other; and when the arcuate portions of the paired arms are joined together in a ring shape, a clearance is defined between an inner one of the paired thread support portions and an outer periphery of the flange portion, while the base plate portion and a face of the flange portion face each other in the superposing direction of the first member and the second member with a clearance therebetween.

7. The pompon making tool according to claim 6, wherein the flange portion includes, on a face thereof that is oriented inward when the first member and the second member are superposed on each other, a rib protruding in the superposing direction of the first member and the second member.

8. The pompon making tool according to claim 6, wherein a face of the base plate portion and a face of the flange portion that face each other are respectively provided with projecting pieces sticking out in the superposing direction of the first member and the second member, at a position corresponding to where the height of the paired thread support portions from the base plate portion to the top portion is relatively low.

9. The pompon making tool according to claim 1, wherein the base plate portion of the first member and that of the second member which overlap each other when the first member and the second member are superposed on each other are provided, on mutually facing surfaces thereof, with positioning means for achieving positioning by fitting a projection and a recess.

10. The pompon making tool according to claim 1, wherein the arcuate portions each is provided with a plurality of guide projections formed on an outer periphery thereof, such that each of the guide projections on one of the arcuate portions forms a pair with a respective one of the guide projections of the facing arcuate portion at a longitudinally corresponding position when the arcuate portions of the paired arms are joined together in a ring shape with the first member and the second member superposed on each other.

11. The pompon making tool according to claim 1, wherein the arcuate portions each is provided, on an outer periphery thereof, with a hook portion for engaging a thread, such that the hook portion of one of the arcuate portions forms a pair with that of the facing arcuate portion at a longitudinally corresponding position when the arcuate portions of the paired arms are joined together in a ring shape with the first member and the second member superposed on each other.

* * * * *